US007340784B2

(12) United States Patent
Stryker et al.

(10) Patent No.: US 7,340,784 B2
(45) Date of Patent: Mar. 11, 2008

(54) PATIENT TRANSFER DEVICE

(75) Inventors: Martin W. Stryker, Kalamazoo, MI (US); Jeffrey L. Lewandowski, Delton, MI (US); James T. Thwaites, Delton, MI (US); Richard J. Bartow, Battle Creek, MI (US); Scott Smieja, Ripon, MI (US); David P. Marcusen, Appleton, WI (US)

(73) Assignee: Stryker Corporation, Kalamazoo, MI (US)

( * ) Notice: Subject to any disclaimer, the term of this patent is extended or adjusted under 35 U.S.C. 154(b) by 205 days.

(21) Appl. No.: 11/151,064

(22) Filed: Jun. 13, 2005

(65) Prior Publication Data

US 2006/0090258 A1 May 4, 2006

Related U.S. Application Data

(60) Provisional application No. 60/623,950, filed on Nov. 1, 2004.

(51) Int. Cl.
*A61G 7/10* (2006.01)

(52) U.S. Cl. ..... 5/81.1 HS; 5/81.1 R; 5/88.1

(58) Field of Classification Search ..... 5/81.1 R–89.1; 242/371, 379, 390.2, 407; 24/460, 462
See application file for complete search history.

(56) References Cited

U.S. PATENT DOCUMENTS

| | | | |
|---|---|---|---|
| 1,815,006 | A | 7/1931 | Horsting et al. |
| 2,498,853 | A | 2/1950 | Hassold et al. |
| 2,665,432 | A | 1/1954 | Butler |
| 2,710,975 | A | 6/1955 | Stoen et al. |
| 2,733,452 | A | 2/1956 | Tanney |
| 2,761,153 | A | 9/1956 | Mew |
| 2,812,524 | A | 11/1957 | Pruitt |
| 2,826,766 | A | 3/1958 | Stoner |
| 2,827,642 | A | 3/1958 | Huff |
| 2,959,792 | A | 11/1960 | Haugard |
| 3,317,928 | A | 5/1967 | Root |
| 3,597,774 | A | 8/1971 | Warren |
| 3,757,359 | A | 9/1973 | Stellman |
| 3,761,153 | A | 9/1973 | Guth |

(Continued)

FOREIGN PATENT DOCUMENTS

| | | |
|---|---|---|
| DE | 2 257 572 | 5/1974 |

(Continued)

*Primary Examiner*—Patricia Engle
*Assistant Examiner*—Jonathan Liu
(74) *Attorney, Agent, or Firm*—Van Dyke, Gardner, Linn & Burkhart, LLP

(57) ABSTRACT

A patient transfer device includes a base assembly movable in forward and lateral directions. A power train is mounted within the base assembly, and is connected to a clamping and strap assembly. A power and switching system is in electrical communication with the power train. A retractor bar carries one or more clamping devices that are releasably attachable to a sheet. The clamping devices include a clamp handle pivotally connected to a clamp base and a clamp arm eccentrically pivotally connected to the clamp handle. The clamping and strap assembly is supported on the base assembly by a vertical adjustment assembly that includes a positioning mechanism for releasably locking the clamping and strap assembly at one of a plurality of vertical positions. An attendant can stand on the base assembly to act as a counterbalance to a patient's weight.

29 Claims, 34 Drawing Sheets

U.S. PATENT DOCUMENTS

| | | | | |
|---|---|---|---|---|
| 3,875,623 | A | 4/1975 | Johnston | |
| 4,011,609 | A | 3/1977 | Bethlen | |
| 4,077,073 | A | 3/1978 | Koll et al. | |
| 4,194,253 | A | 3/1980 | Ullven | |
| 4,195,375 | A | 4/1980 | Paul | |
| 4,644,595 | A | 2/1987 | Daniel | |
| 4,747,170 | A | 5/1988 | Knouse | |
| 4,776,047 | A | 10/1988 | DiMatteo | |
| 4,850,562 | A | 7/1989 | Mazzanti | |
| 4,868,938 | A | 9/1989 | Knouse | |
| 5,072,840 | A | 12/1991 | Asakawa et al. | |
| 5,168,587 | A | 12/1992 | Shutes | |
| 5,271,110 | A | 12/1993 | Newman | |
| 5,379,468 | A | 1/1995 | Cassidy et al. | |
| 5,489,258 | A * | 2/1996 | Wohnsen et al. | 602/5 |
| 5,539,941 | A | 7/1996 | Fuller | |
| 5,697,109 | A | 12/1997 | Hodgetts | |
| 5,737,781 | A | 4/1998 | Votel | |
| 5,819,339 | A | 10/1998 | Hodgetts | |
| 5,890,238 | A | 4/1999 | Votel | |
| 5,996,144 | A | 12/1999 | Hodgetts | |
| 6,289,533 | B1 | 9/2001 | Hodgetts | |
| 6,289,539 | B1 * | 9/2001 | Alpern | 5/662 |
| 6,341,393 | B1 | 1/2002 | Votel | |
| 6,378,148 | B1 | 4/2002 | Votel | |
| 6,496,991 | B1 * | 12/2002 | Votel | 5/81.1 HS |
| 6,507,963 | B2 | 1/2003 | Hodgetts | |
| 6,615,423 | B2 | 9/2003 | Sverdlik et al. | |
| 6,662,388 | B2 | 12/2003 | Friel et al. | |
| 6,728,979 | B1 | 5/2004 | Robert | |
| 6,772,456 | B2 | 8/2004 | Votel | |
| 2002/0029418 | A1 | 3/2002 | Votel | |
| 2003/0074732 | A1 | 4/2003 | Hanson et al. | |
| 2003/0110559 | A1 | 6/2003 | Weigand | |
| 2003/0110560 | A1 | 6/2003 | Friel et al. | |

FOREIGN PATENT DOCUMENTS

| | | |
|---|---|---|
| DE | 2 308 436 | 8/1974 |
| FR | 1 512 074 | 12/1967 |
| GB | 7869 | 0/1895 |
| GB | 420 697 | 12/1934 |
| GB | 2 068 850 A | 8/1981 |

* cited by examiner

PATIENT TRANSFER DEVICE

CROSS REFERENCE TO RELATED APPLICATIONS

This application claims the benefit of U.S. Provisional Application Ser. No. 60/623,950, filed Nov. 1, 2004.

FIELD OF THE INVENTION

The invention relates to a patient transfer device, specifically a device for transferring a patient from one patient support apparatus to another. In one of its aspects, the invention relates to a patient transfer device for shifting a patient position on a patient support apparatus.

BACKGROUND OF THE INVENTION

Patient transfer devices configured to move a patient from one hospital bed to another, or to a transport gurney, are generally known.

It would be advantageous to provide a patient transfer device that is portable, does not require attachment to a patient support apparatus, and that is configured to readily convey a patient without the provision of specially configured sheets.

SUMMARY OF THE INVENTION

A patient transfer device for pull-up, rollover and transfer of a patient disposed on a sheet comprises a base assembly including one or more wheels for movement of the caddy and one or more wheels for lateral positioning of the caddy, the wheels for lateral positioning of the caddy being operably independent of and mutually exclusive of the wheels for movement of the caddy, a power train mounted within the base assembly, and a clamping and strap assembly including one or more straps attachable to the power train. A retractor bar is attachable to the one or more straps and one or more clamping devices are pivotally attached to the retractor bar and releasably attachable to the sheet. The clamping device includes a clamp handle pivotally connected to a clamp base and a clamp arm eccentrically pivotally connected to the clamp handle. The clamping device is pivotal between a clamping position and a non-clamping position. The clamp arm includes a bight portion for engaging a clamping face of the clamping base and a pair of arm portions for pivotally connecting to the clamp handle. A power and switching system is in electrical communication with the power train.

A vertical adjustment assembly is operably adjoined between the base assembly and the clamping and strap assembly for adjusting the vertical position of the clamping and strap assembly. The vertical adjustment assembly includes a pair of upstanding rails and a pair of upstanding sleeves slidably receiving the rails, the rails including a plurality of spaced indentations defining a plurality of vertical positions of the clamping and strap assembly. At least one of the sleeves includes a positioning mechanism for releasably locking the clamping and strap assembly at one of the plurality of vertical positions.

BRIEF DESCRIPTION OF THE DRAWINGS

The purposes of the invention will be apparent to persons acquainted with apparatus of this general type upon reading the following specification and inspecting the accompanying drawings, in which.

DETAILED DESCRIPTION OF THE INVENTION

Figure 1:
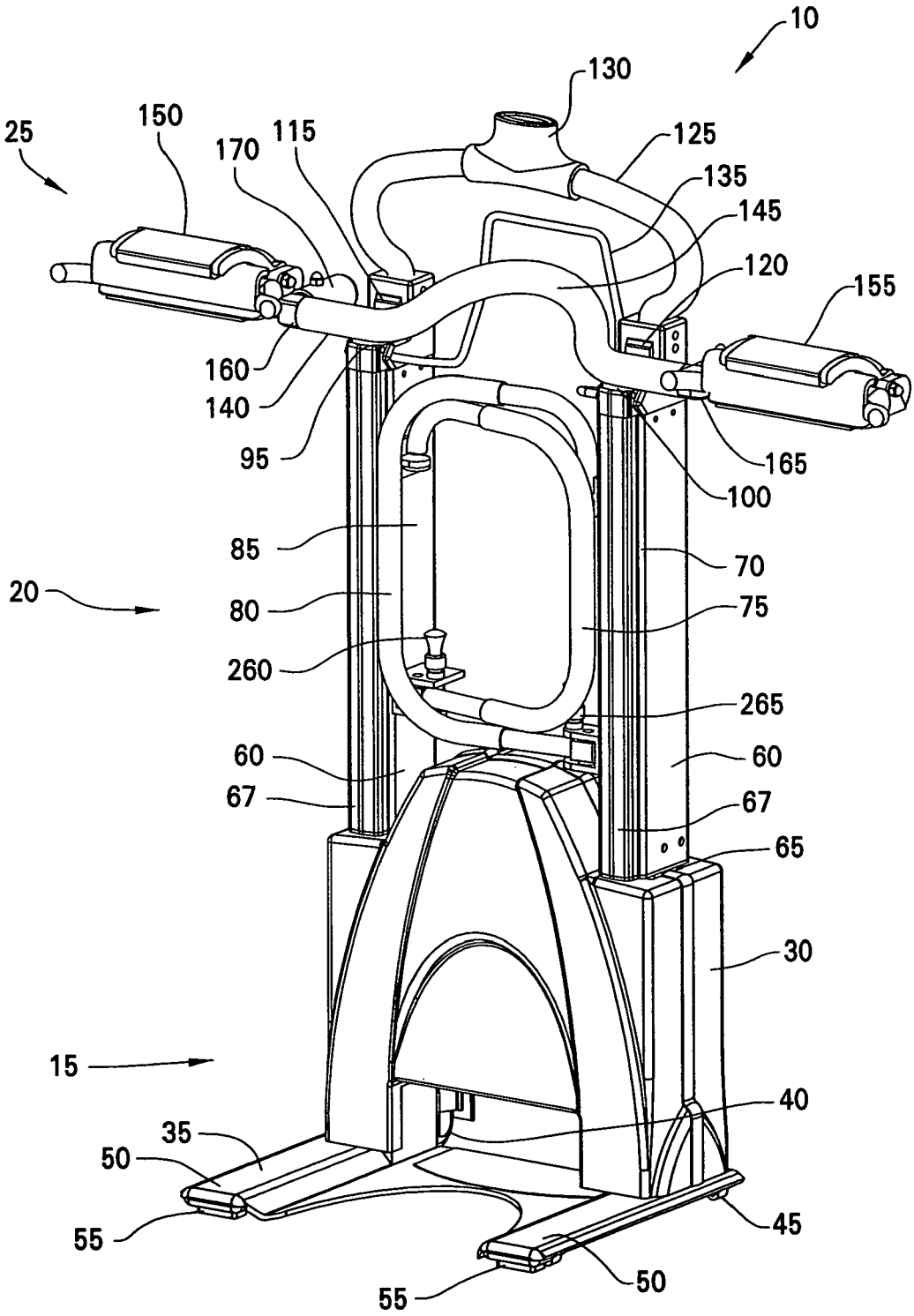
FIG. 1 is a perspective view of a patient transfer device according to the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

Referring to FIG. 1, a patient transfer device 10 according to the invention is illustrated. The patient transfer device 10 comprises a base assembly 15, a rail assembly 20, and a retractor assembly 25.

The base assembly 15 comprises a base housing 30 supported on a base deck 35. The base assembly further comprises transport wheels 40 and lateral positioning wheels 45. The base deck 35 includes a pair of extending toes 50 under which are mounted a pair of anti-slip rubber toenails 55.

The rail assembly 20 includes a pair of vertical rail sleeves 60 received on a pair of vertical rails 65 connected to the base housing 30. Each vertical rail sleeve 60 includes a resilient bumper strip 67 on a front face 70 thereof. A standoff assembly comprises a pair of standoff tubes 75, 80 pivotally mounted to an inner face 85, 90 of the vertical rail sleeves 60. A sill 95, 100 is provided at an upper end of each vertical rail sleeve 60 for supporting the retractor assembly 25. Adjacent to each sill 95, 100, a retractor strap aperture 105, 110 (see FIG. 30) and an associated safety shut off switch 115, 120 are provided. The upper ends of the vertical rail sleeves 60 are connected by a handle 125 incorporating a retractor activation switch 130. A vertical adjustment lock lever 135 is further pivotally connected between the upper ends of the vertical rail sleeves 60.

The retractor assembly 25 includes a retractor bar 140 having a head relief portion 145 and a pair of sheet clamping assemblies 150, 155 attached to each end 160, 165 by a respective pivot assembly 170, 175.

Figure 2:
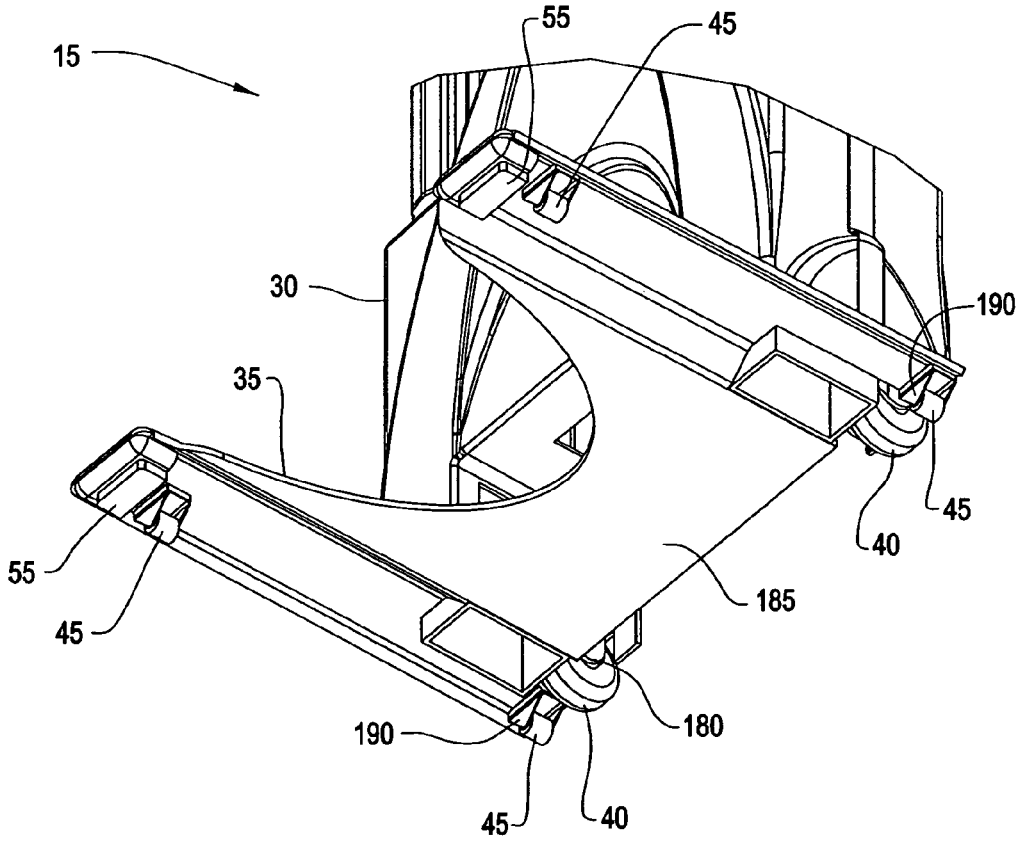
FIG. 2 is a bottom perspective view of a base assembly of the patient transfer device of FIG. 1.

Referring now to FIG. 2, the base assembly 15 includes the pair of transport wheels 40. The transport wheels 40 are rotatably mounted on the base assembly 15 on a fixed axle 180 arranged transversely on the base assembly 15. The transport wheels 40 are thereby configured to provide fore and aft movement of the patient transfer device 10. The base assembly 15 is further provided with the lateral positioning wheels 45 mounted to an underside 185 of the base deck 35. The lateral positioning wheels 45 are each rotatably mounted on one of a plurality of parallel fixed axles 190 arranged on base deck 35 and configured to provide transverse movement of the patient transfer device 10. It is further contemplated that the lateral positioning wheels 45 can be swivel-mounted to the underside 185 of base deck 35, thereby being configured to provide positioning movement of the patient transfer device in all directions.

Figure 3A:
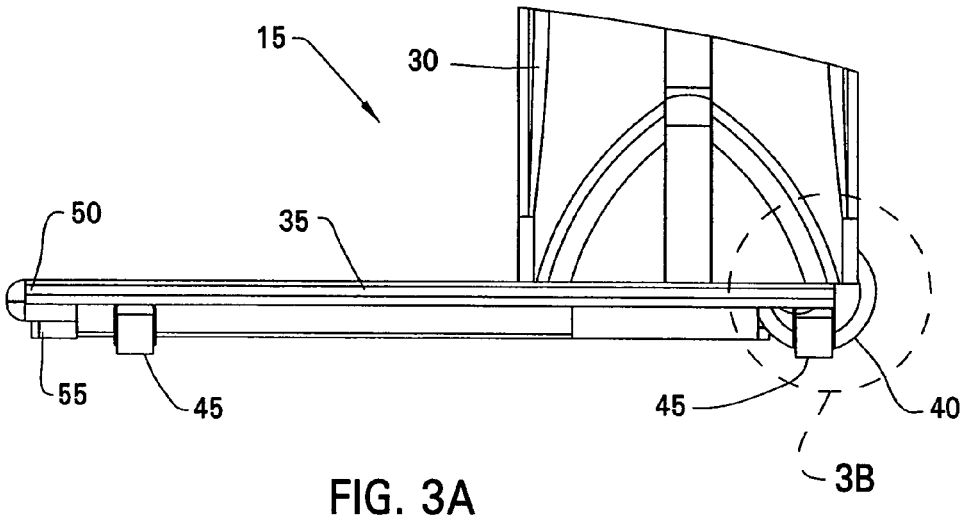
FIG. 3A is a side view of the base assembly of FIG. 2 in a horizontal position.
Figure 3B:
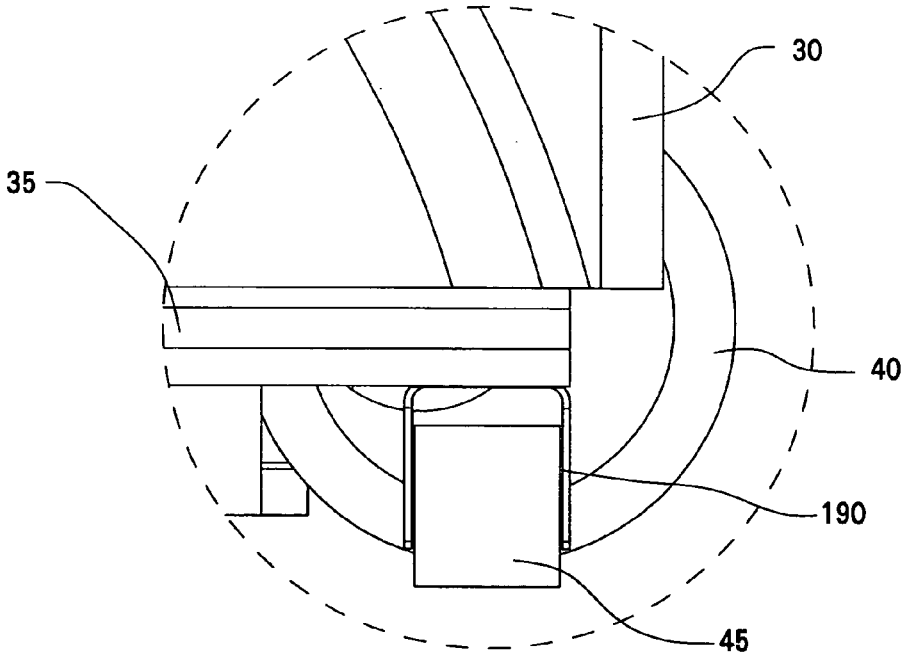
FIG. 3B is an enlarged detail view according to FIG. 3A.

Referring now to FIGS. 3A and 3B, the patient transfer device 10 is shown with the base deck 35 parallel to a floor surface. In the horizontal position of the base deck 35, the lateral positioning wheels 45 are in contact with the floor surface to enable lateral movement of the patient transfer device 10. As best seen from FIG. 3B, the transport wheel 40 is not in contact with the floor surface with the patient transfer device 10 in the horizontal orientation.

Figure 4A:
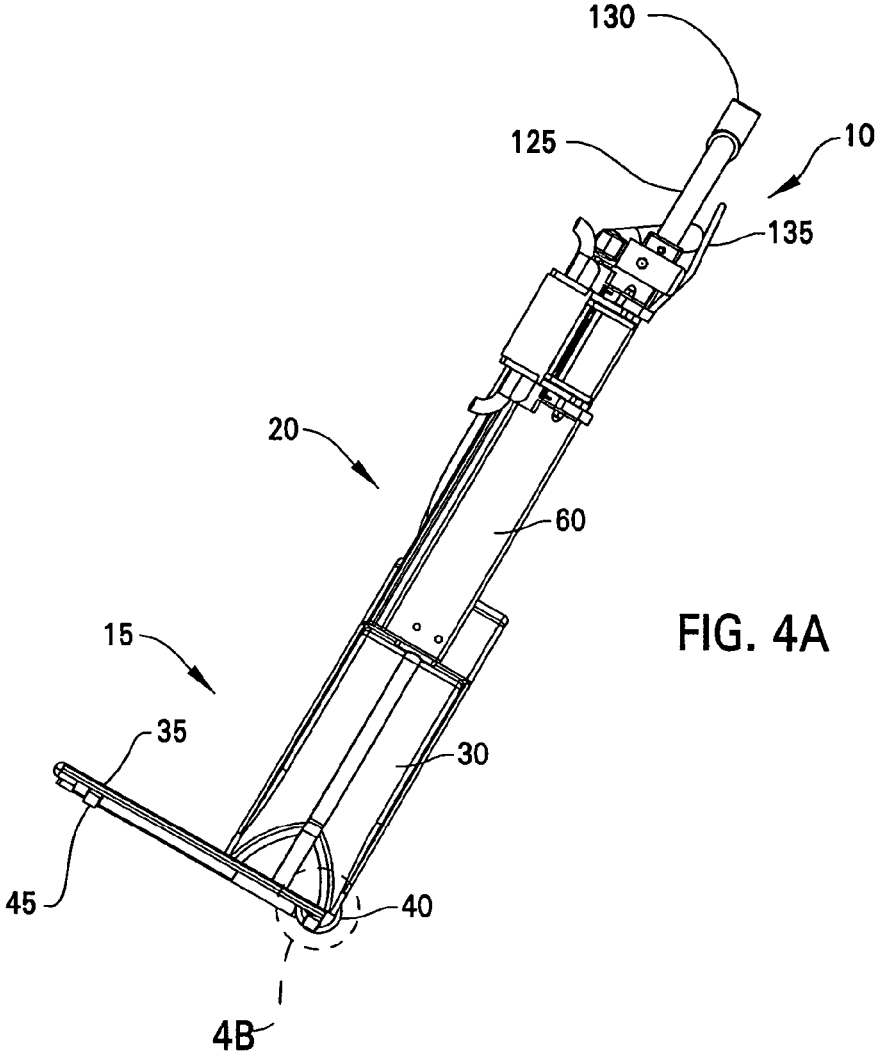
FIG. 4A is a side view of the patient transfer device of FIGS. 1 through 3.
Figure 4B:
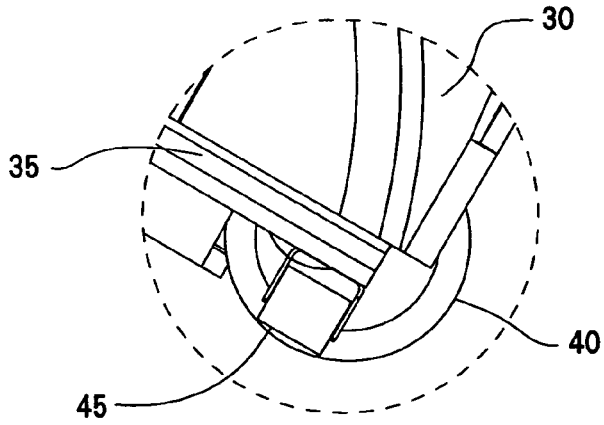
FIG. 4B is an enlarged detail view according to FIG. 4A.

Referring now to FIGS. 4A and 4B, the patient transfer device 10 is titled rearwardly, raising the base deck 35 away from the floor surface. As best shown in FIG. 4B, as the patient transfer device 10 is tilted rearwardly, the transport wheels 40 are configured to contact the floor surface and raise the lateral positioning wheels 45 off of the floor surface to facilitate transport of the patient transfer device 10 on the transport wheels 40.

The base housing 30 encloses a power supply and a motor and gear assembly operably connected to the retractor assembly 25 through the vertical rails 65. The motor assembly is activated by the retractor activation switch 130 mounted on the handle 125.

Figure 5:
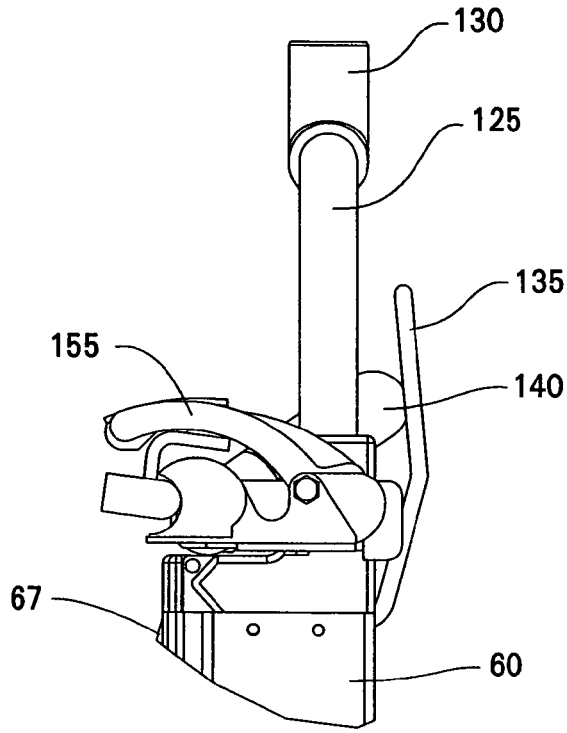
FIG. 5 is a side view of the patient transfer device of FIGS. 1 through 4 with a lock lever in a locked position.
Figure 6:
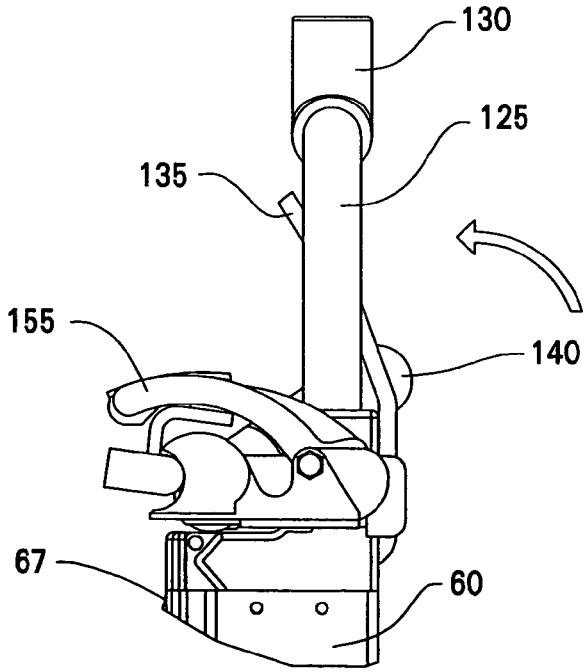
FIG. 6 is a side view of the patient transfer device of FIGS. 1 to 4 with a lock lever in the unlocked position.

Referring to FIGS. 5 and 6, the vertical adjustment lock lever 135 is pivotally mounted to the vertical rail sleeves 60, and is rotatable from a locked position shown in FIG. 5 to an unlocked position shown in FIG. 6. The vertical adjustment lock lever 135 is positioned adjacent the handle 125 and is configured so that an operator grasping the handle 125 will not inadvertently activate the lock lever 135. However, an operator grasping the handle 125 can reach the lock lever 135 for intentional operation.

Figure 7:
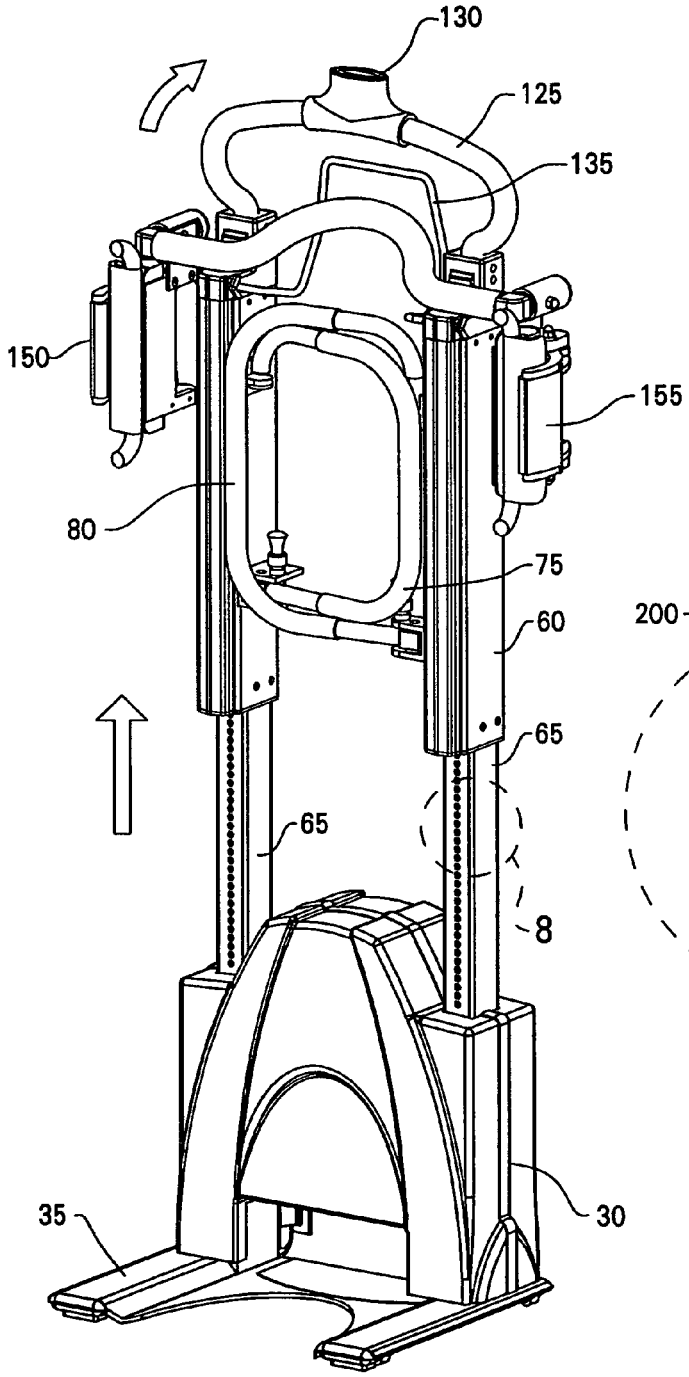
FIG. 7 is a perspective view of the patient transfer device of FIGS. 1 through 6 with a rail assembly in the extended position.
Figure 8:
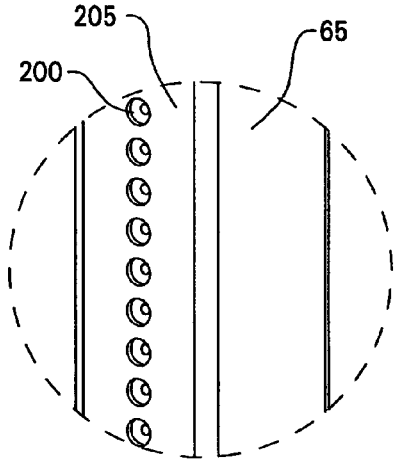
FIG. 8 is an enlarged detail view according to FIG. 7.

Referring now to FIGS. 7-8, the rail sleeves 60 are slidably mounted on the vertical rails 65. With the lock lever 135 in the unlocked position, the rail sleeves 60 are released to slide vertically on the vertical rails 65. As shown in the detail of FIG. 7B, the vertical rails 65 include a plurality of pockets 200 on a front face 205 of the vertical rail 65. A ball-ramp locking mechanism (not shown), as is well known in the art, is operably connected to the locking lever 135, the pockets 200 in the vertical rail 65 being configured to receive a ball bearing of the ball-ramp locking mechanism when the locking lever is released to the locked position. The vertical rail sleeves 60 are thereby configured for locking in one of a plurality of vertical height positions corresponding to the pockets 200 found on the front face 205 of the vertical rails 65.

Figure 9:
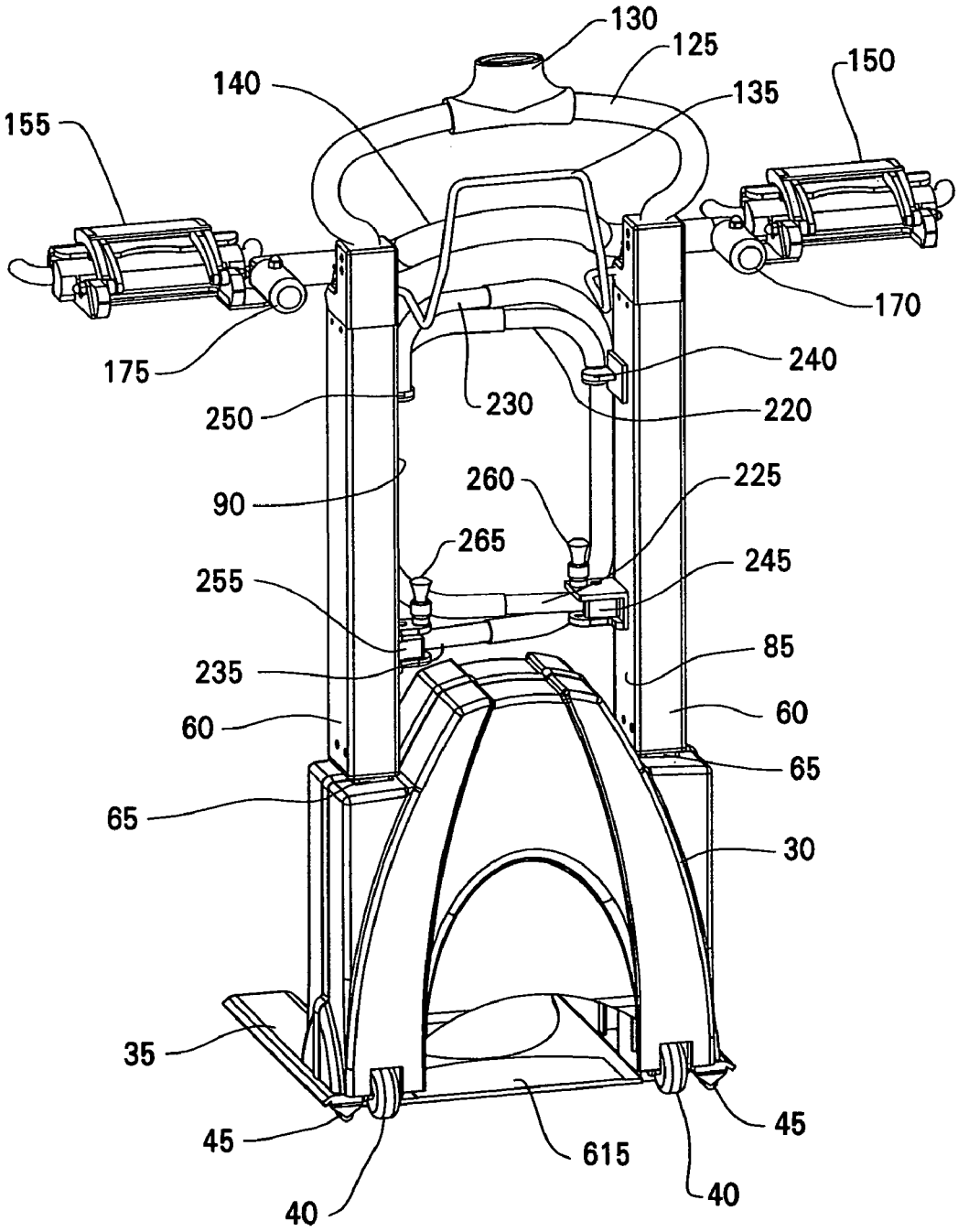
FIG. 9 is a reverse perspective view of the patient transfer device of FIGS. 1 through 8.
Figure 10:
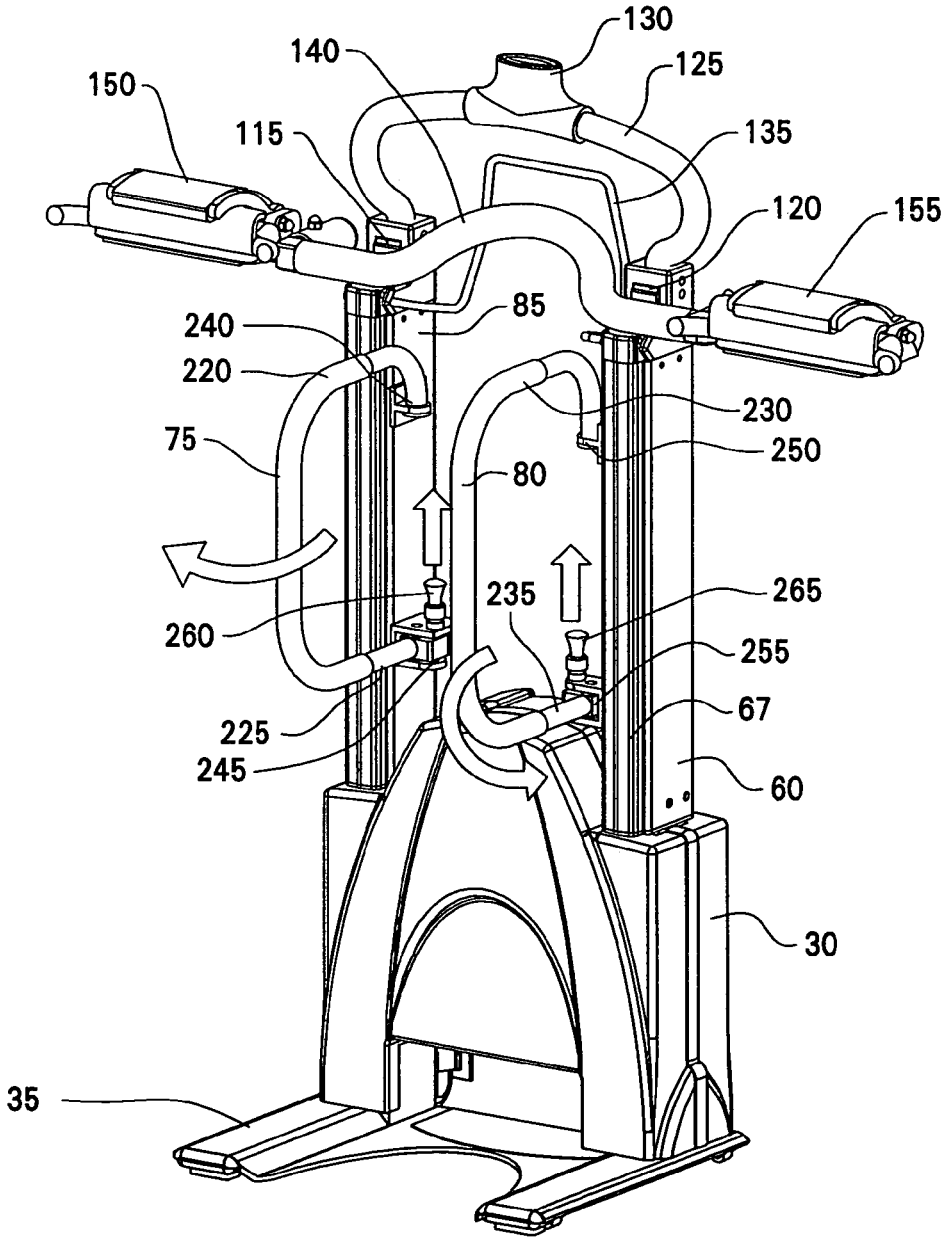
FIG. 10 is a perspective view of the patient transfer device of FIGS. 1 through 9 with the stand off tubes extended.

Referring now to FIGS. 9-10, the standoff assembly, comprising the standoff tubes 75, 80, is shown pivotally mounted to the inner faces 85, 90 of the vertical rail sleeves 60. The standoff tubes 75, 80 each include a bight portion 210, 215. The standoff tube 75 further includes an upper leg 220 and a lower leg 225. The standoff tube 80 includes an upper leg 230 and a lower leg 235. The upper leg 220 of the standoff tube 75 is pivotally mounted to a hinge bracket 240 mounted to the inner face 85 of vertical rail sleeve 60. The lower arm 225 of the standoff tube 75 is pivotally mounted to a spring-loaded plunger lock mechanism 245 attached to the inner face 85 of the vertical rail sleeve 60. In like fashion, the upper leg portion 230 of the standoff tube 80 is pivotally mounted to a hinge bracket 250 attached to the inner face 90 of the vertical rail sleeve 60. The lower leg portion 235 of the standoff tube 80 is further pivotally connected to a spring-loaded plunger lock mechanism 255 mounted on the inner face 90 of the vertical rail sleeve 60. As shown in FIG. 10, a vertical plunger knob 260, 265 is configured to be lifted to release the spring-loaded plunger lock mechanism 245, 255, thereby releasing the standoff tubes 75, 80 to rotate from their nested position between the vertical rail sleeves 60 to a forwardly extending deployed position. It should be noted that, while the standoff assembly is illustrated as comprising standoff tubes 75, 80, it is further anticipated that the standoff assembly can comprise panels pivotally attached to the vertical rail sleeves 60.

Figure 12:
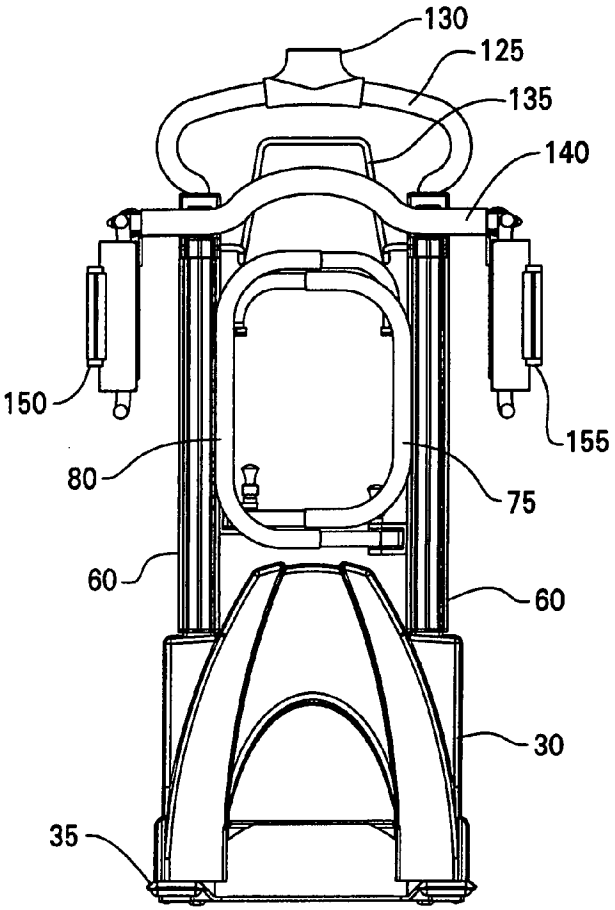
FIG. 12 is a front view of the patient transfer device of FIGS. 1 through 11 with the sheet clamping assemblies in the stowed position.
Figure 11:
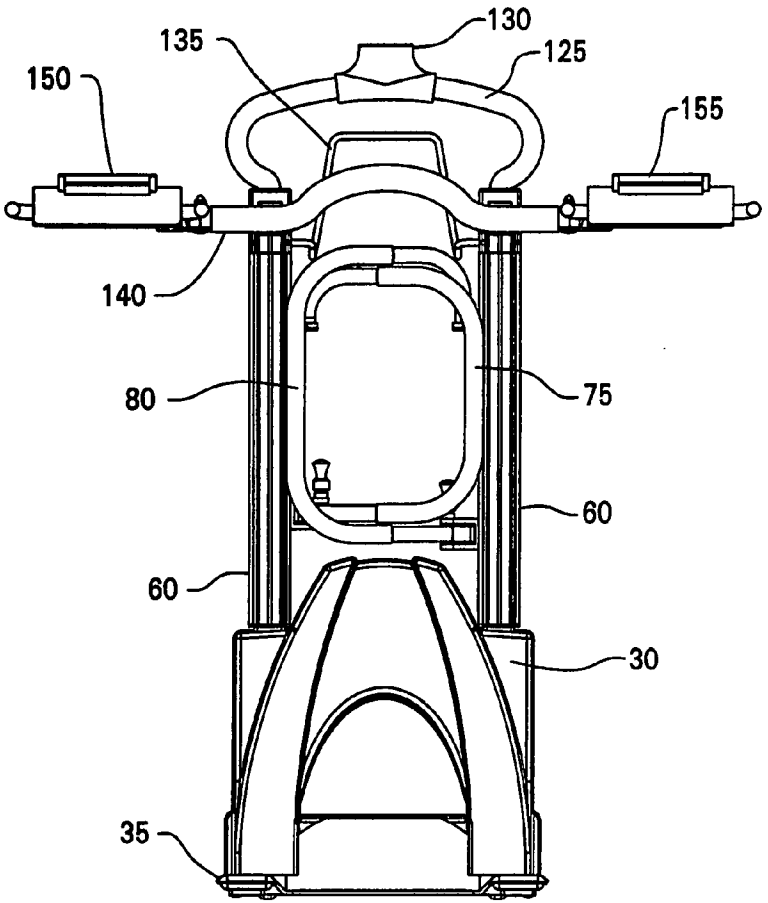
FIG. 11 is a front view of the patient transfer device of FIGS. 1 through 10 with the sheet clamping assemblies extended.
Figure 13:
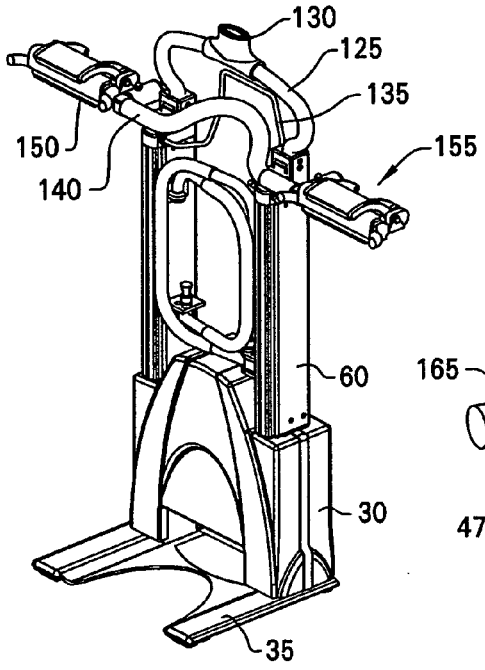
FIG. 13 is a perspective view of the patient transfer device of FIGS. 1 through 12.
Figure 14:
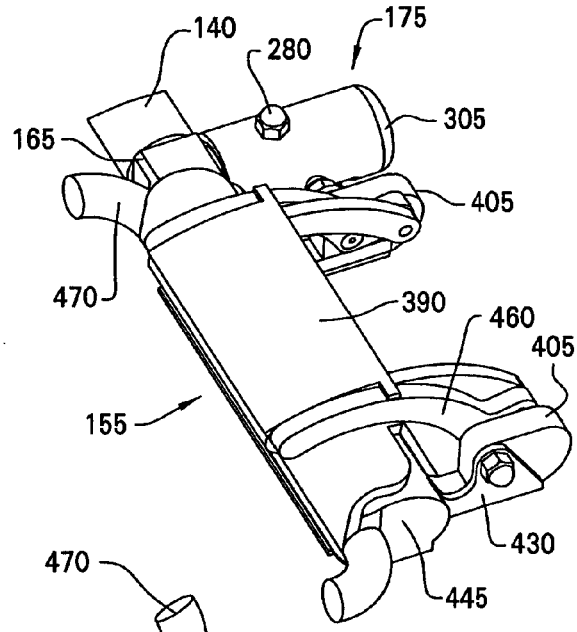
FIG. 14 is an enlarged view of a sheet clamping assembly of the patient transfer device of FIGS. 1 through 13.
Figure 15:
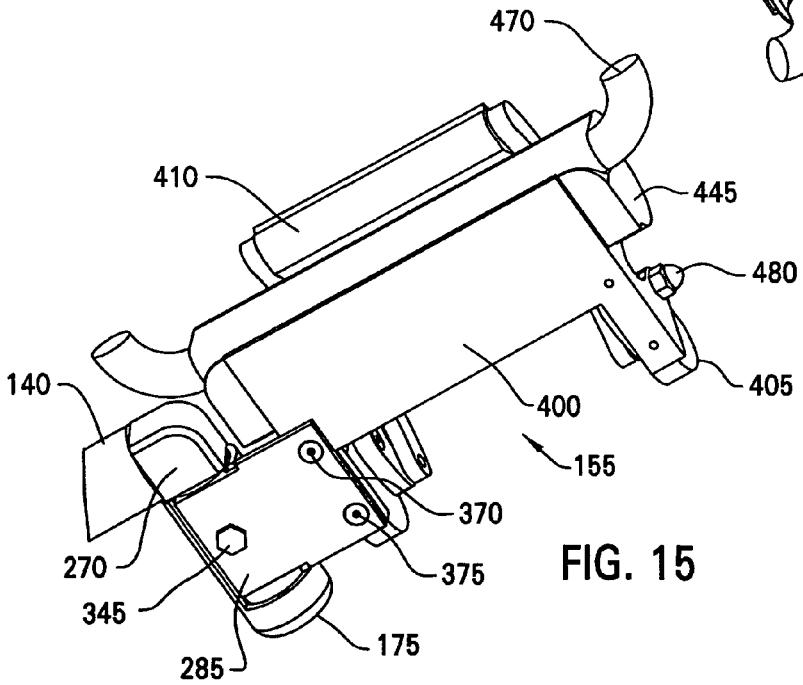
FIG. 15 is a bottom perspective view of the sheet clamping assembly of FIG. 14.
Figure 16:
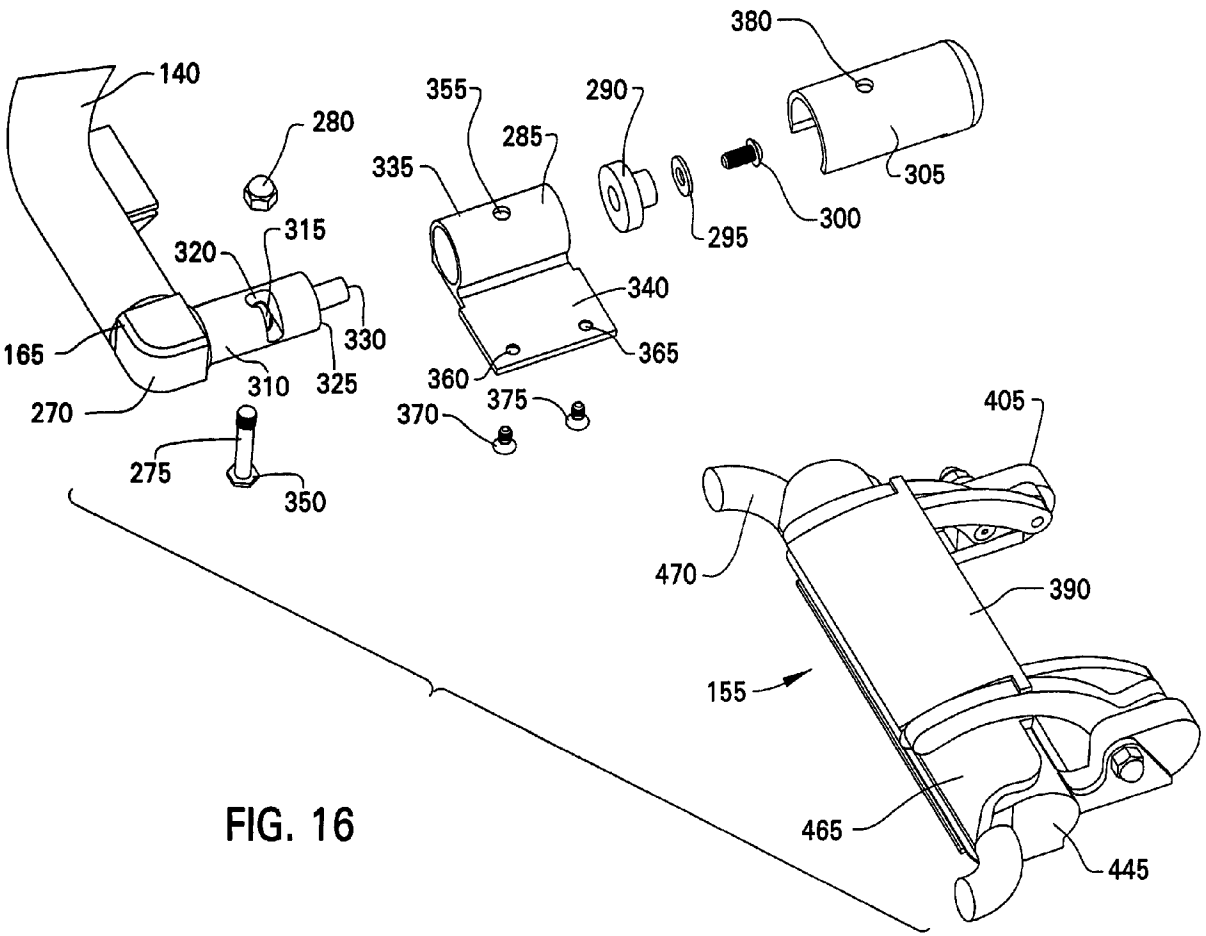
FIG. 16 is an exploded perspective view of the sheet clamping assembly of FIGS. 14 and 15.

The sheet clamping assemblies 150, 155 are pivotally mounted to the retractor bar 140 by the pivot assemblies 170, 175, and are configured to pivot from an operational position shown in FIG. 11 to a stored position shown in FIG. 12. The stored position, wherein the sheet clamping assemblies 150, 155 depend from the retractor bar 140, presents a narrower profile of the patient transfer device 10 than the operational position, for ease in transport and storage. The following description of the sheet clamping assembly 155 and associated pivot assembly 175 are equally applicable to the sheet clamping assembly 150 and the pivot assembly 170.

Referring to FIGS. 13-16, the sheet clamping assembly 155 is pivotally mounted to the end 165 of the retractor bar 140 by the pivot assembly 175. The pivot assembly 175 comprises a pivot arm 270 attached to the end 165 of the retractor bar 140, a pivot screw 275 with a pivot nut 280, a pivot base 285, a rubber bushing 290, a retainer washer and screw 295, 300 and a pivot cap 305.

The pivot arm 270 includes a cylindrical body 310 including a partial circumferential through slot 315 having a detent portion 320. The cylindrical body 310 terminates in a shoulder 325 surrounding an internally threaded stud 330 extending from the end of the cylindrical body 310. The pivot base 285 is comprised of a cylindrical sleeve 335 and a tangentially extending flange 340. The flange 340 includes a hexagonal recess 345 (see FIG. 15) for receiving a head 350 of the pivot screw 275. The hexagonal recess surrounds an aperture 355 passing through the cylindrical sleeve 335. The pivot base is thereby configured to receive the pivot screw through the aperture 355 and through the cylindrical sleeve, with the head 350 of the pivot screw 275 received in the recess 345. The flange 340 further includes a pair of apertures 360, 365 for receiving a pair of screws 370, 375 adapted to mount the sheet clamping assembly 155 to the pivot base 285.

The pivot cap 305 is a partial cylindrical sleeve adapted for sliding over the cylindrical sleeve 335 of the pivot base 285, and includes an aperture 380 configured to align with the aperture 355 of the pivot base 285.

The pivot assembly 175 is assembled in the following manner: the cylindrical sleeve 335 of the pivot base 285 is slidably received on the cylindrical body 310 of the pivot arm 270. The rubber bushing 290 is then slidably received on the stud 330 against the shoulder 325 of the cylindrical body 310. The rubber bushing is then retained on the stud 330 by the retainer washer and screw 295, 300. The pivot cap 305 is then slid over the cylindrical sleeve 335 of the pivot base 285, enclosing the rubber bushing 290 and the retainer washer and screw 295, 300, until the aperture 380 aligns with the aperture 355. The apertures 355, 380 are aligned with a portion of the slot 315, and the pivot screw 275 is inserted through the aperture 355, through the slots 315 and out through the aperture 380. The pivot screw 275 is secured in place by the pivot nut 280. The sheet clamping assembly 155 is secured to the flange 340 of the pivot base 285 by the screws 370, 375.

Figure 17:
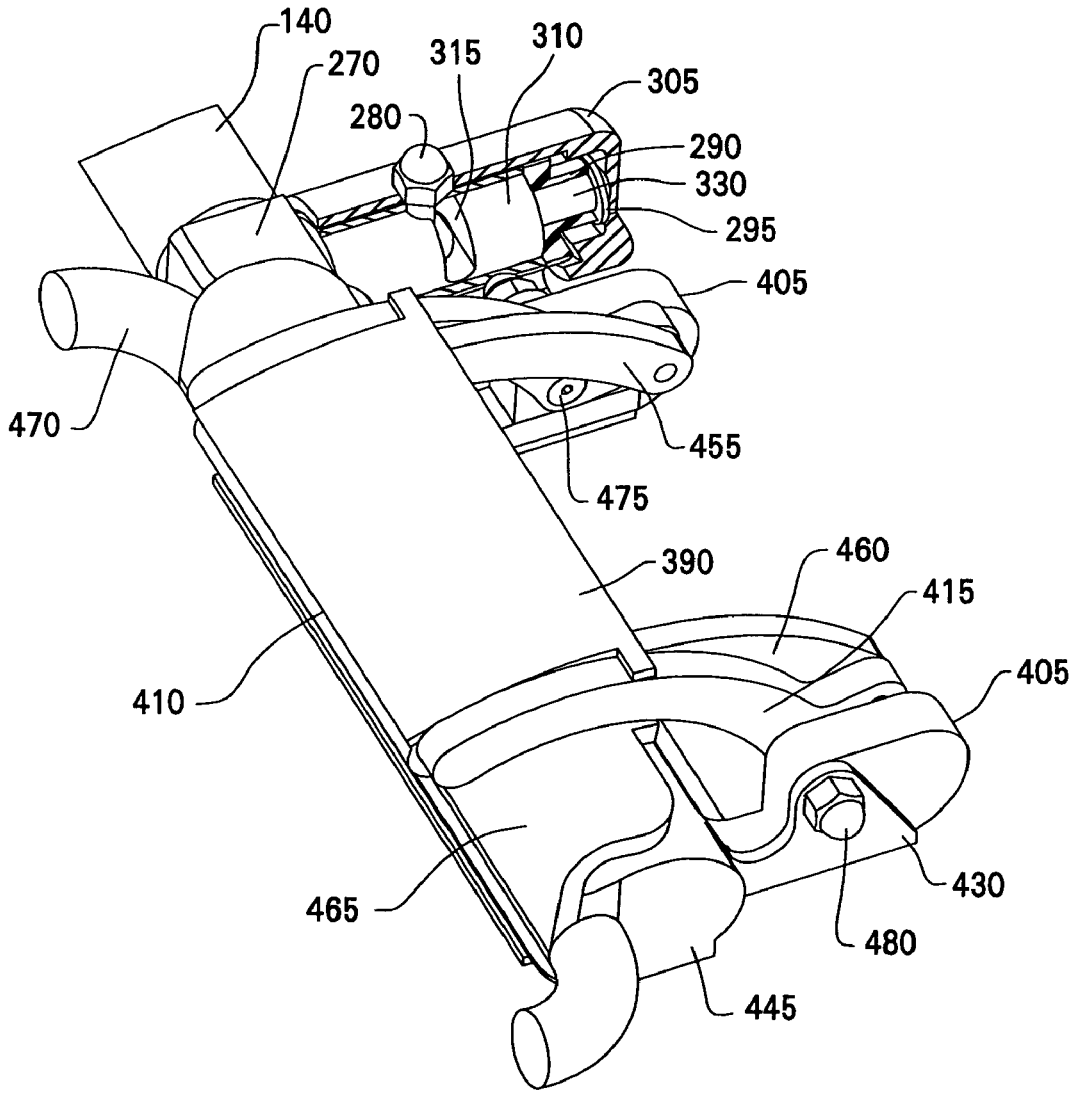
FIG. 17 is a partial cutaway perspective view of the sheet clamping assembly of FIGS. 14 through 16.

As shown in FIG. 17, the cylindrical sleeve 335 of the pivot base 285 is urged by the rubber bushing 290 such that the pivot screw 275 is urged into the detent portion 320 of the slot 315. With the pivot screw 275 in the detent portion 320 of the slot 315, the sheet clamping assembly 155 is retained in the operational position of FIG. 11.

Figure 18:
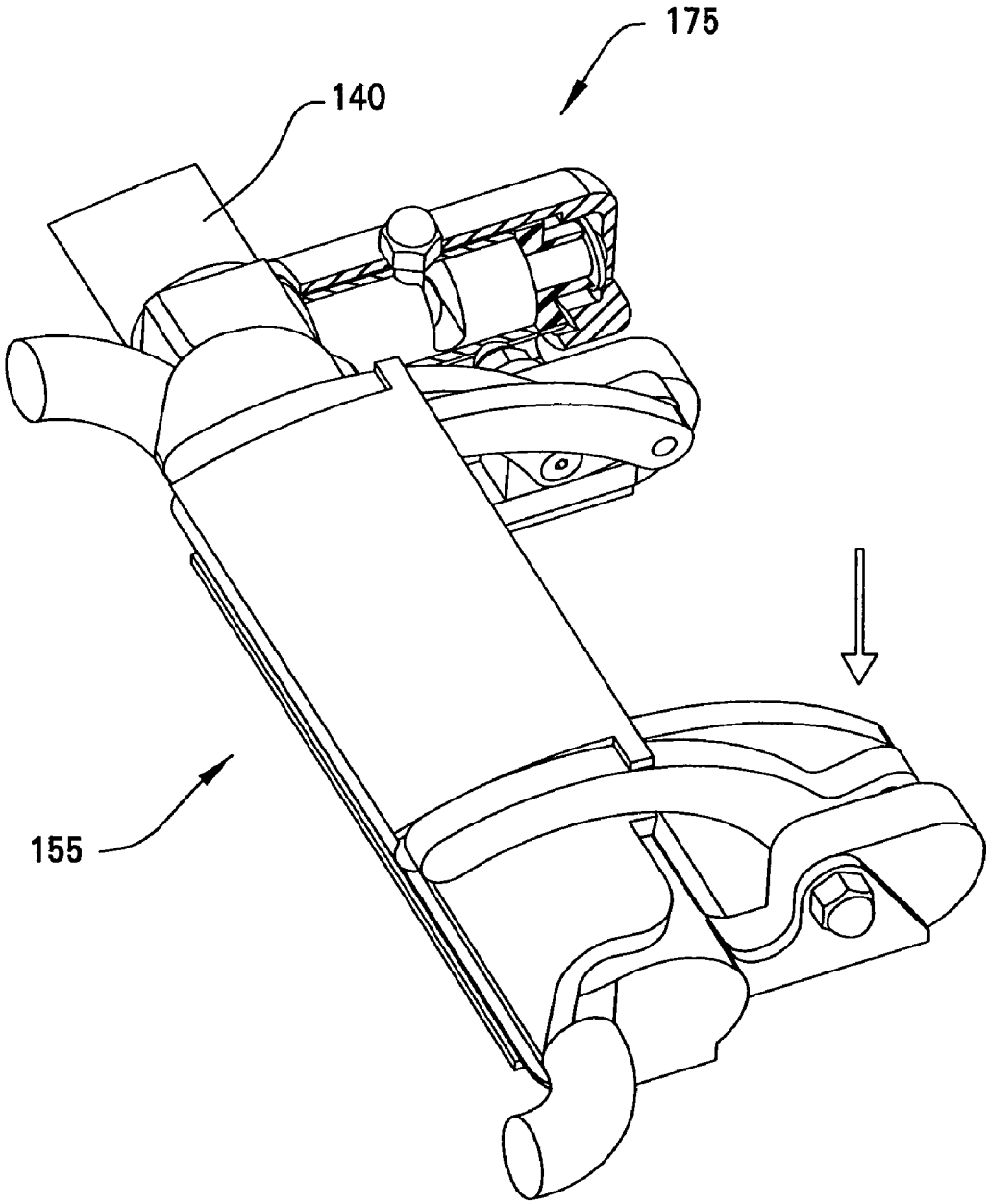
FIG. 18 is a perspective view of a sheet clamping assembly according to FIGS. 1 through 17.
Figure 19:
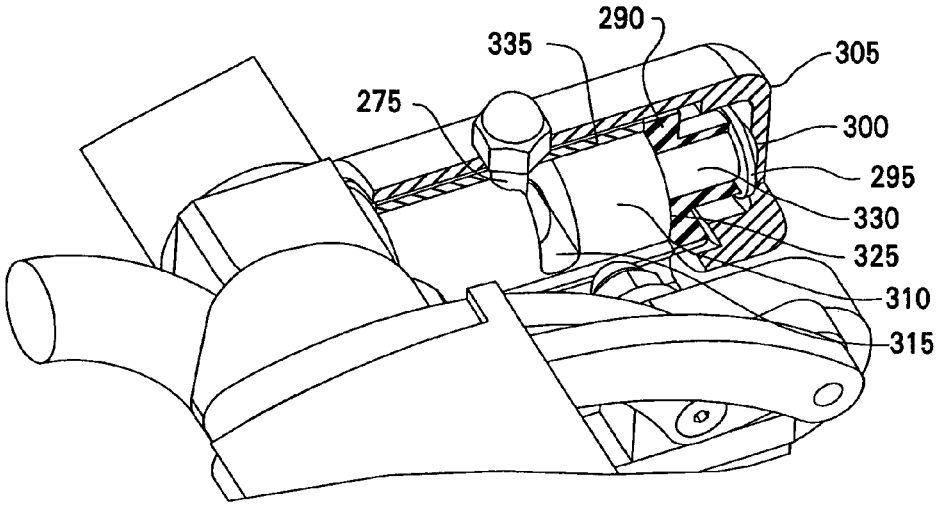
FIG. 19 is an enlarged detail view of a pivot assembly according to FIGS. 1 through 18.
Figure 20:
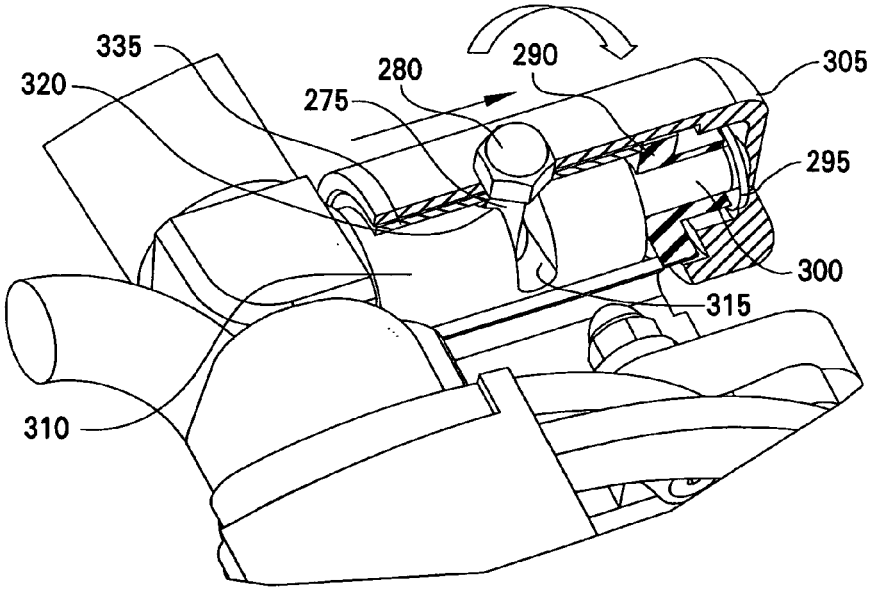
FIG. 20 is an enlarged perspective view of a pivot assembly according to FIG. 19 in a disengaging condition.

Referring to FIGS. 18-20, as a downward force is applied to the sheet clamping assembly 155, the pivot screw 275 is forced out of the detent portion 320 of the slot 315 against the bias of the rubber bushing 290 acting on cylindrical sleeve 335 of pivot base 285 (see FIG. 20). The sheet clamping assembly 155 can then be lowered to the stored position of FIG. 12 as the pivot screw 275 traverses the circumferential slot 315.

The sheet clamping assembly 155 is illustrated in greater detail in FIGS. 21 through 29. The sheet clamping assembly 155 includes a clamp handle 390, a compression assembly 395, a clamp base 400 and a cam guide 405. The clamp handle 390 includes a grip portion 410 and two depending lever arms 415. The clamp base 400 includes a base flange 420 and a pair of upstanding side flanges 425, 430 having apertures 435, 440. The clamping base 400 further includes a clamping receiver 445 having a concave front face 450. The receiver 445 is formed of a high durometer rubber material, and is supported by the base flange 420 and side flanges 425, 430.

The compression assembly 395 includes a pair of clamping arms 455, 460 joined by a clamping carriage 465 carrying a clamping bar 470.

Figure 21:
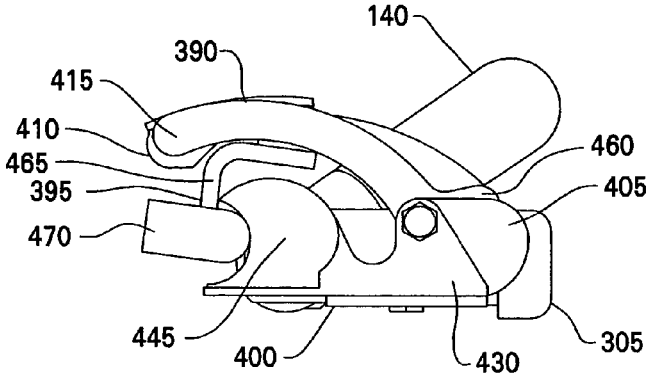
FIG. 21 is a side view of a sheet clamping assembly according to FIGS. 1 through 20.
Figure 22:
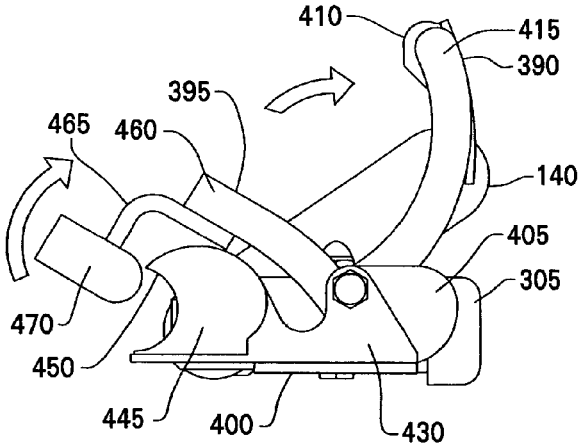
FIG. 22 is a side view of the sheet clamping assembly according to FIG. 21 in a disengaged condition.
Figure 23:
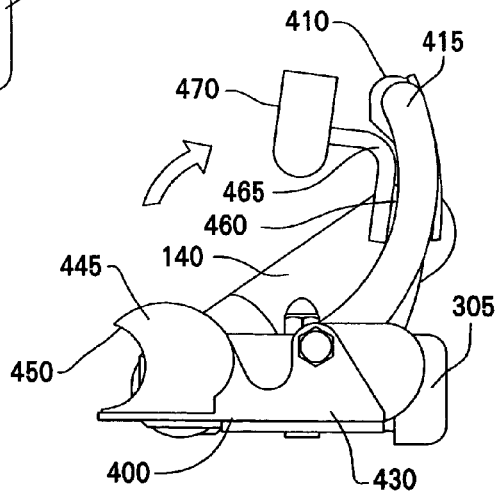
FIG. 23 is a side view of the sheet clamping assembly of FIGS. 21-22 in an open position.
Figure 24:
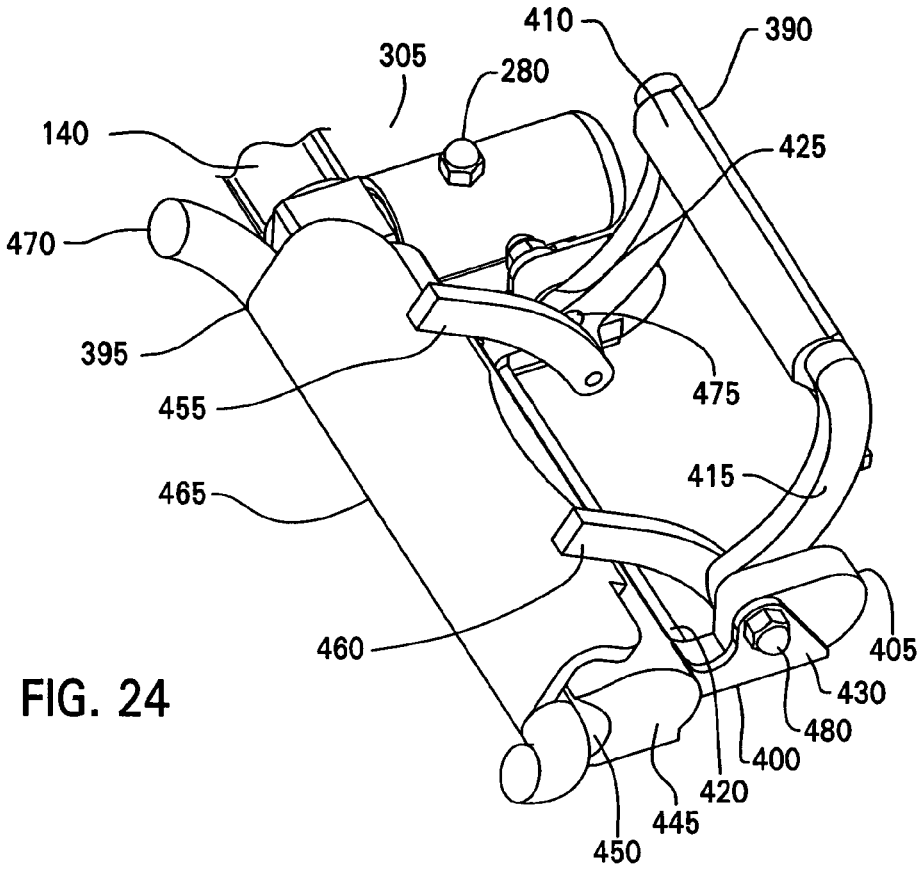
FIG. 24 is a perspective view of the sheet clamping assembly according to FIG. 22.
Figure 25:
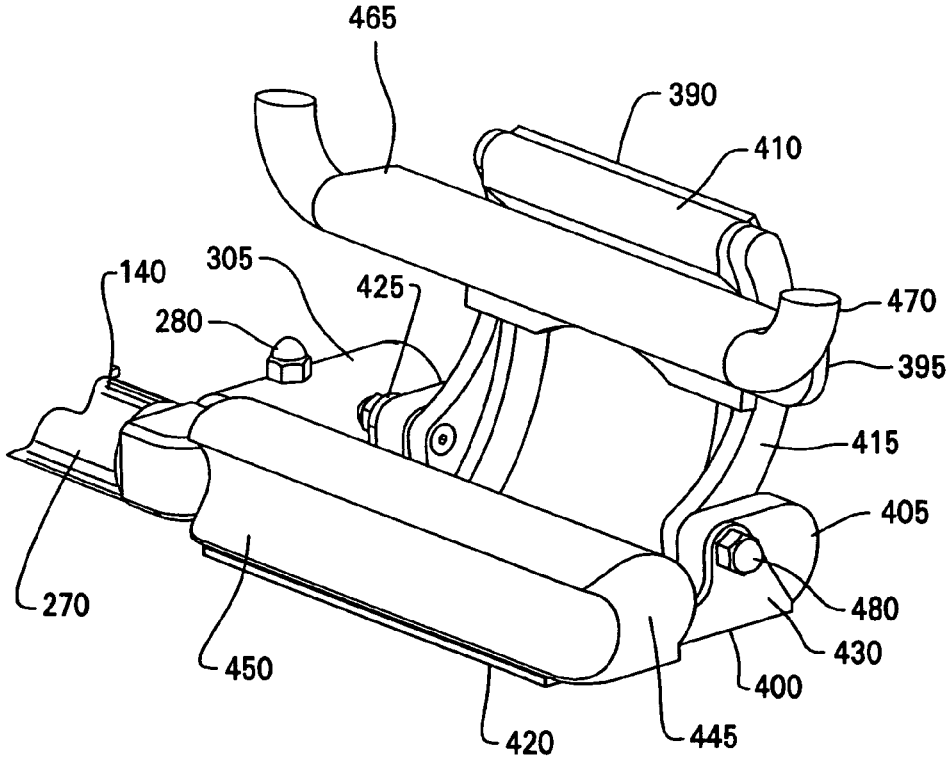
FIG. 25 is a perspective view of the clamping assembly according to FIG. 23.
Figure 26:
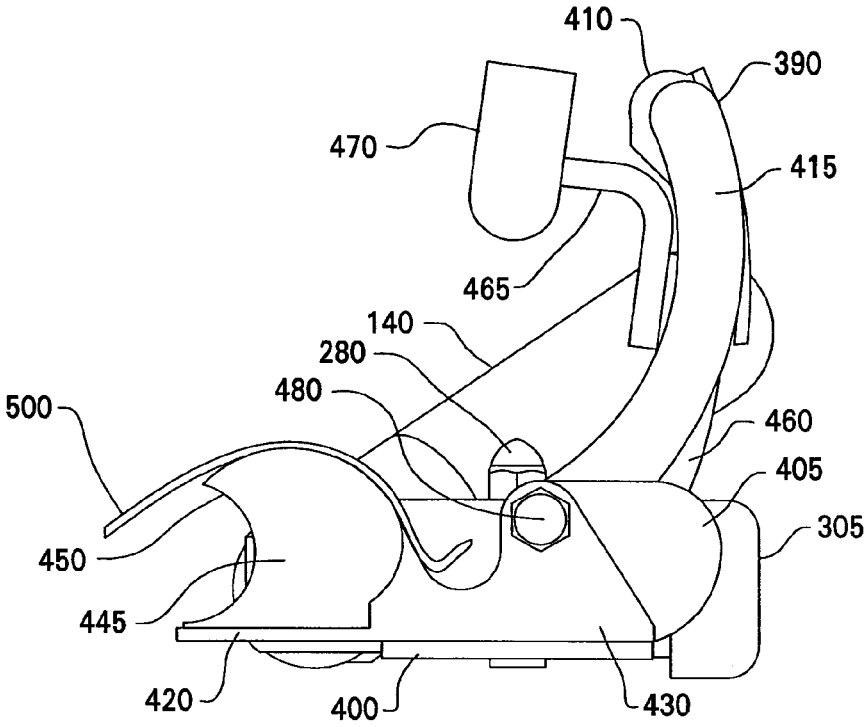
FIG. 26 is a side view of the clamping assembly according to FIGS. 21 through 25 in an open position with a sheet inserted in the clamping assembly.
Figure 27:
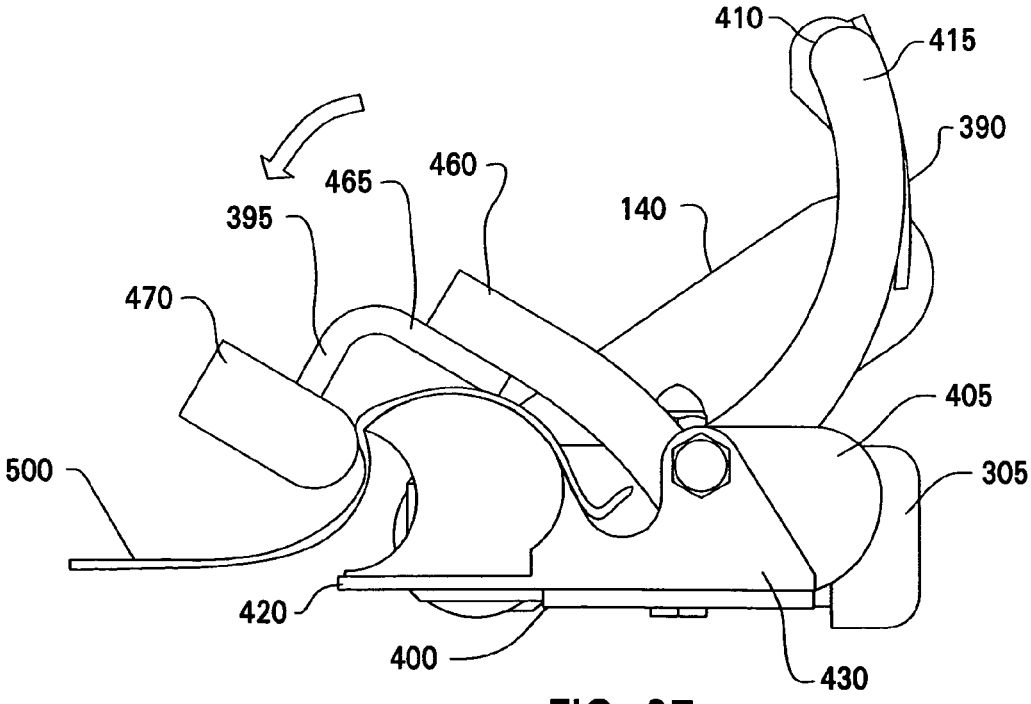
FIG. 27 is a side view of the sheet clamping assembly according to FIGS. 21 through 26 with a sheet inserted in the clamping assembly in a partially closed condition.
Figure 28:
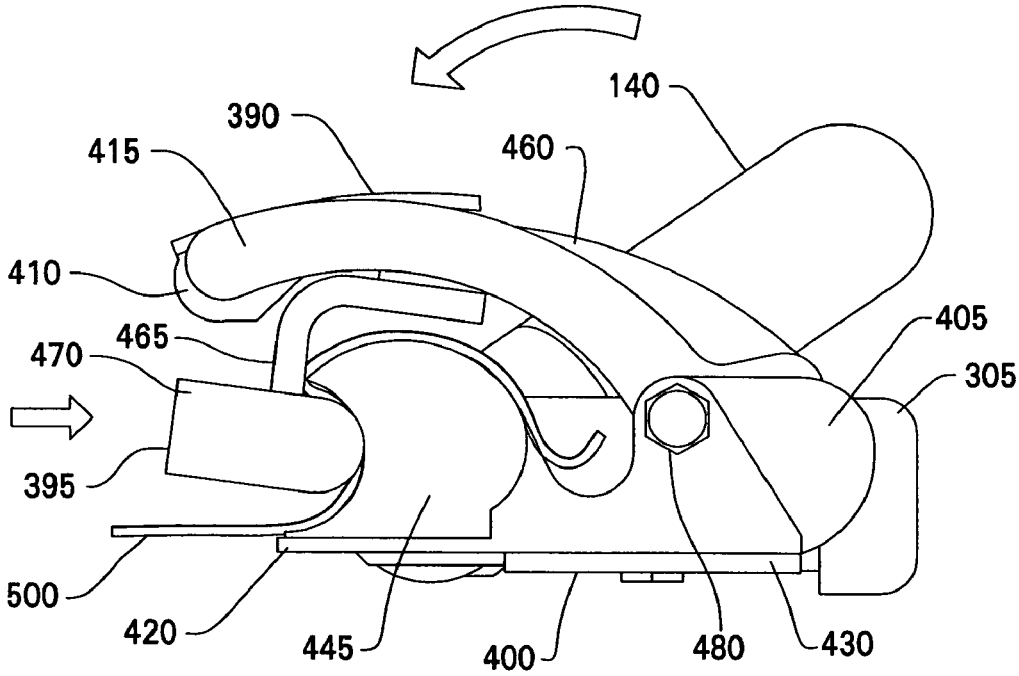
FIG. 28 is the sheet clamping assembly according to FIGS. 21 through 27 with a sheet inserted in the clamping assembly and in a closed condition.

As shown in FIG. 21, the clamping bar 470 is received in the concave front face 450 of the receiver 445, and is in a locked position with the clamp handle 390 rotated forward (or counterclockwise). In order to release the clamping bar 470 from the receiver 445, the clamping handle 390 is rotated clockwise about a pair of fasteners 475, 480 received in the apertures 435, 440 of the side flanges 425, 430. The clamping bar 395 is eccentrically pivotally mounted to the lever arms 415 of the clamp handle 390 such that as the clamp handle 390 is rotated clockwise, the compression assembly 395 is displaced forwardly so that the clamping bar 470 disengages the receiver 445 as shown in FIGS. 22-23. The compression assembly 395 can then be rotated clockwise in order to clear the front face 450 of the receiver 445 as shown in FIGS. 24-25.

Figure 29:
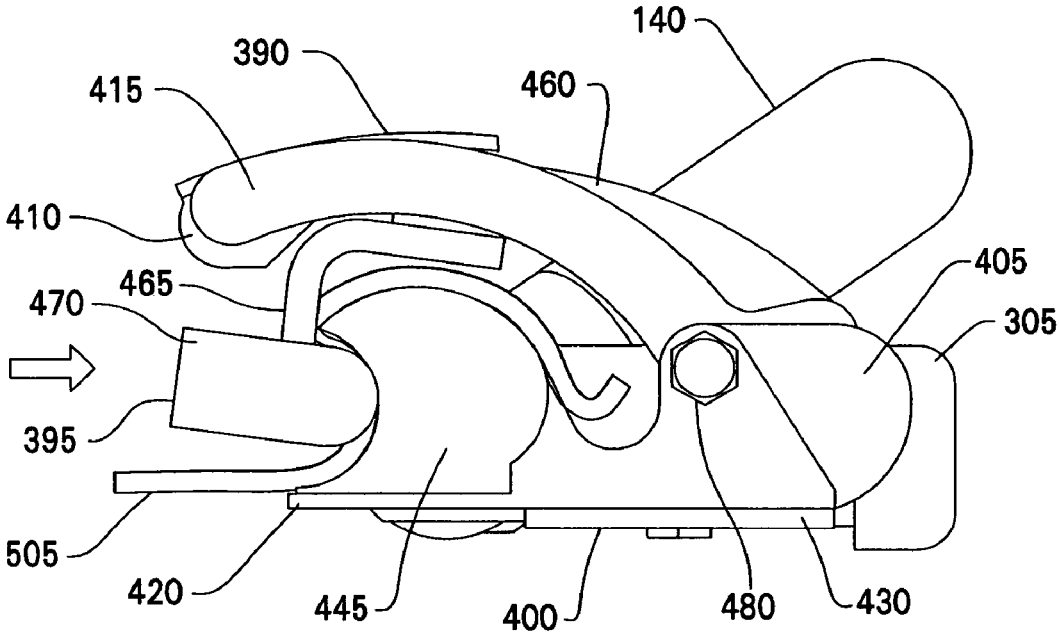
FIG. 29 is a side view of the sheet clamping assembly according to FIGS. 21 through 28 with an alternative sheet inserted in the clamping assembly.

Referring to FIGS. 26-29, a sheet 500 can then be laid over the receiver 445. The compression assembly 395 is then rotated counterclockwise back over the receiver 445, and as the clamp handle 390 is rotated counterclockwise, the clamping bar 470 is drawn into the concave front face 450 of the receiver 445 to trap the sheet 500 therebetween. FIG. 29 illustrates that a sheet 505 that is thicker in cross-section then the sheet 500 can also be retained by the clamping assembly 155 without modification, due to the resilient nature of the receiver 445.

The cam assembly 405 is geometrically configured to cooperate with the clamping arms 455, 460 so that the compression assembly 395 rotates counterclockwise with the clamp handle 390 in a one-handed motion.

Figure 30:
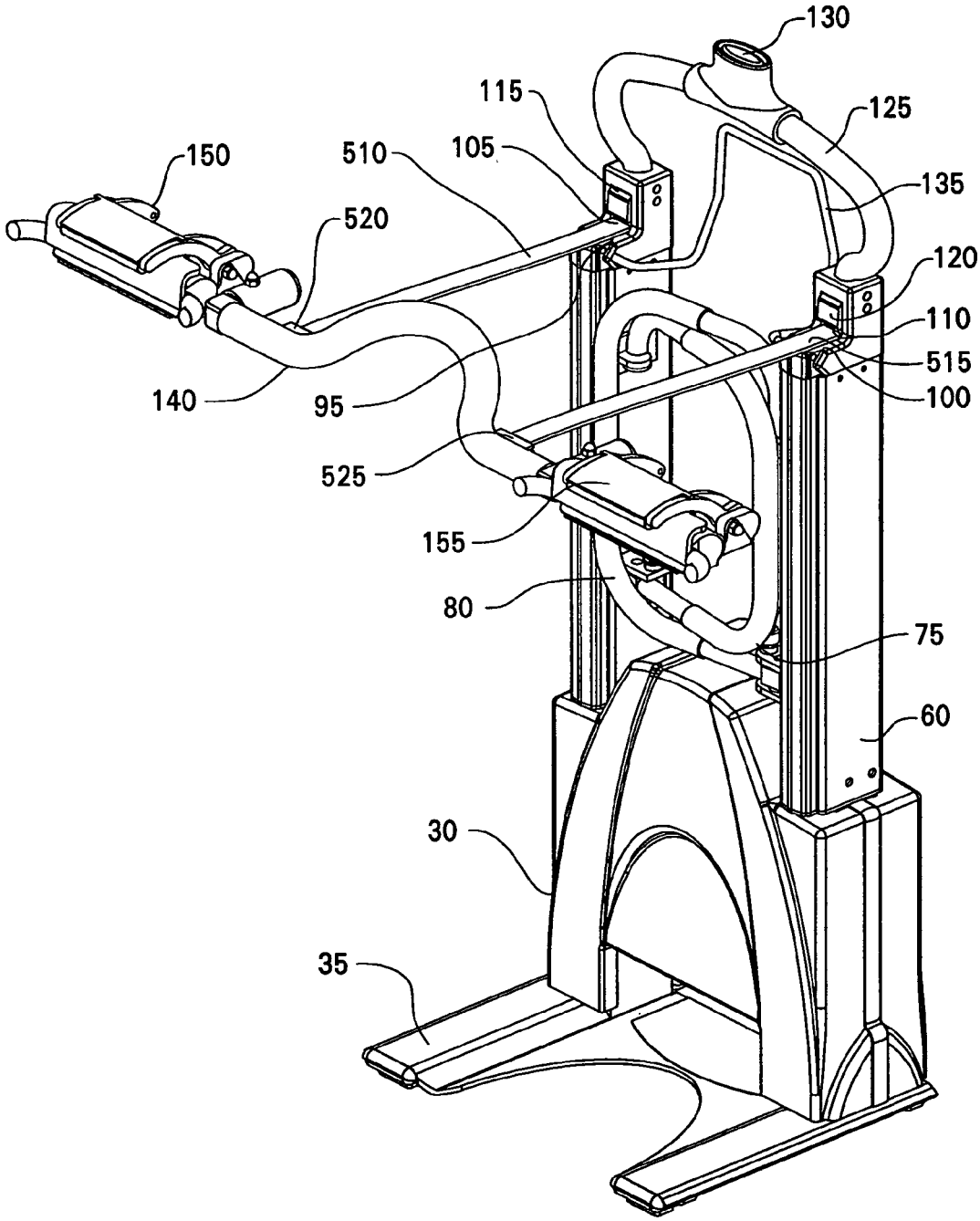
FIG. 30 is a perspective view of the patient transfer device of FIGS. 1 through 29 with the retractor assembly in an extended position.
Figure 31:
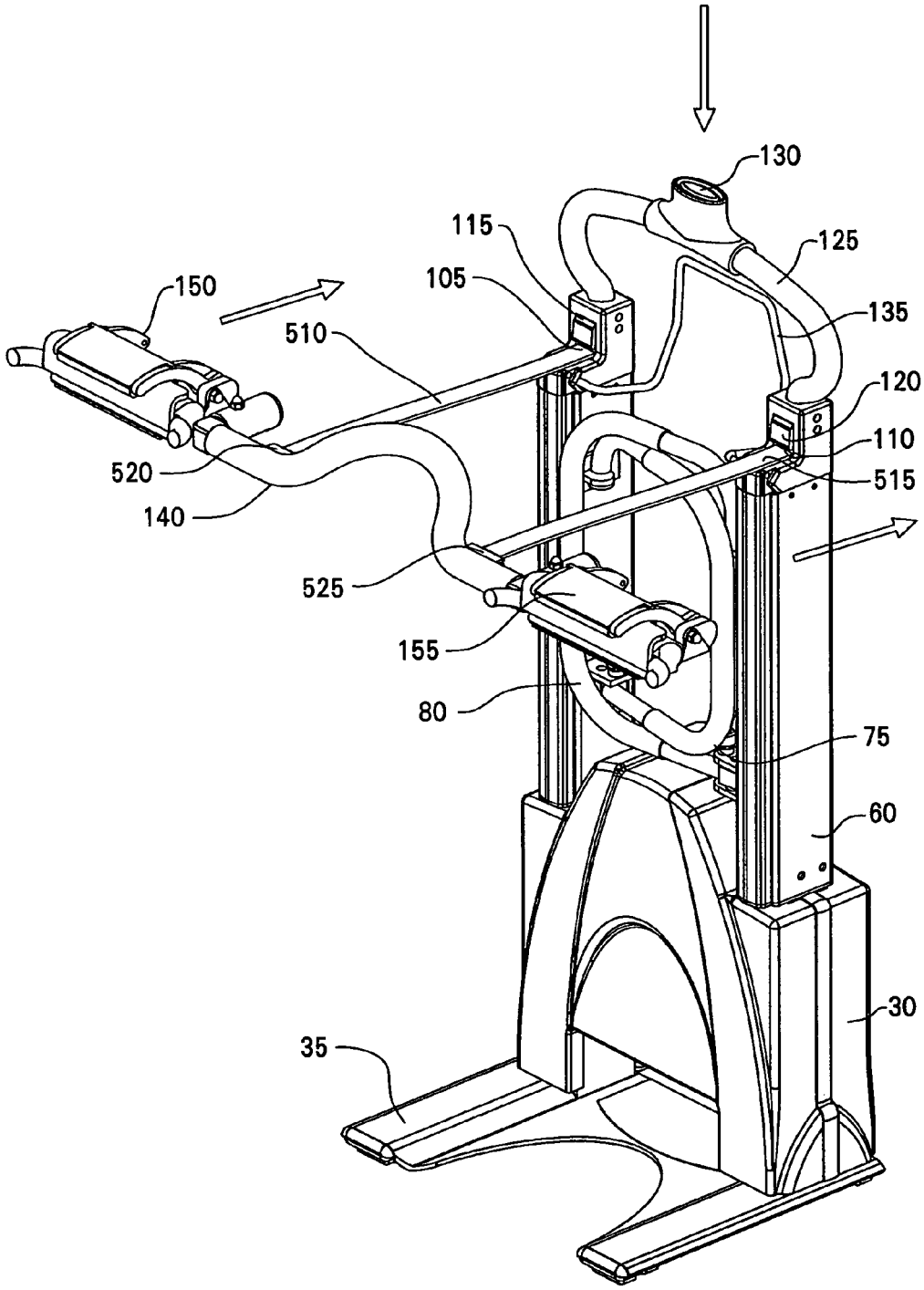
FIG. 31 is a perspective view of the patient transfer device according to FIG. 30.

Referring now to FIG. 30, the retractor assembly 25 is further shown to comprise a pair of retractor straps 510, 515 mounted to the retractor bar 140 by a pair of retractor strap mounts 520, 525 respectively. The retractor straps 510, 515 extend from the retractor bar 140 and into the retractor strap apertures 105, 110 adjacent the safety shut off switches 115, 120 on the rail sleeves 60. The retractor straps 510, 515 then pass through the vertical side rails 65 into the base housing 30, where they are engaged by the motor and gear assembly. At the motor and gear assembly, the retractor straps 510, 515 are attached to two spring-loaded recoil drums and an electronic clutch. The electronic clutch allows the straps 510, 515 to be withdrawn from the patient transfer device 10 so that the retractor bar 140 can be extended. The spring-loaded recoil drums collect the retractor straps 510, 515 without tangling as the retractor bar 140 is returned toward the patient transfer device 10 when it is not under load. When in use, with the retractor assembly 25 extended and attached to a sheet 500 by the sheet clamping assemblies 150, 155, the motor and gear assembly can be activated by the retractor activation switch 130 to draw the straps 510, 515 and the retractor bar 140 toward the patient transfer device 10 (see FIG. 31).

Figure 32A:
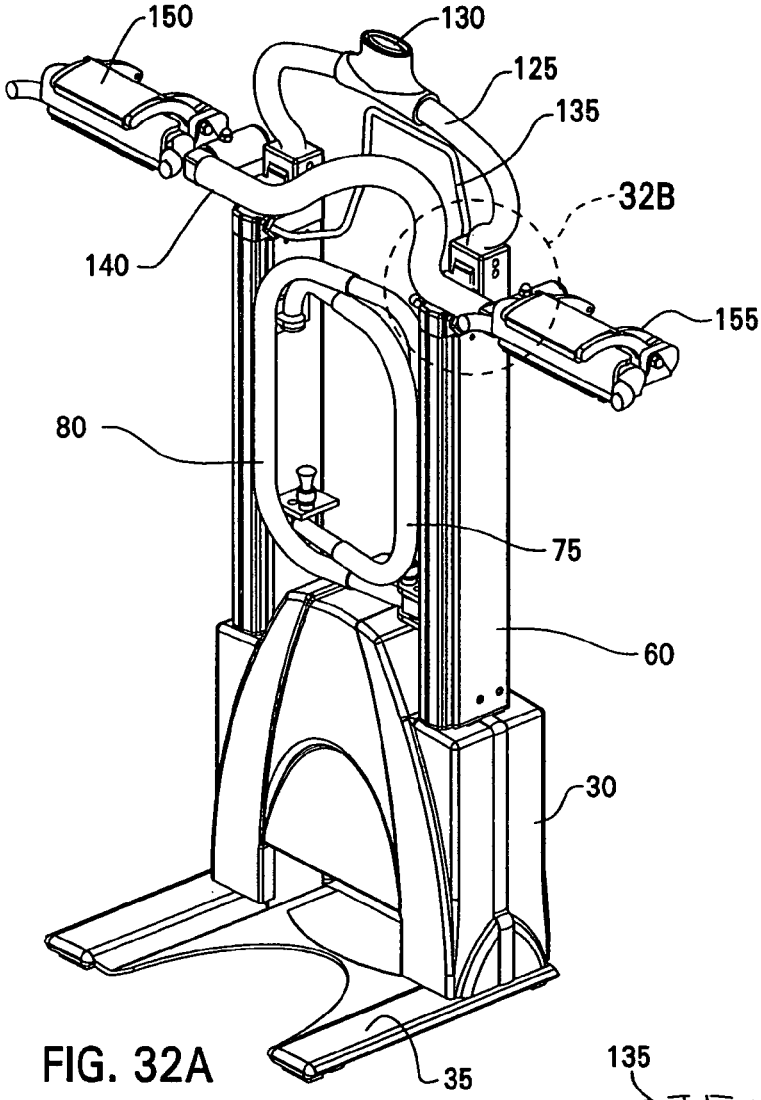
FIG. 32A is a perspective view of the patient transfer device of FIGS. 30 and 31 with the retractor assembly in the retracted position.
Figure 32B:
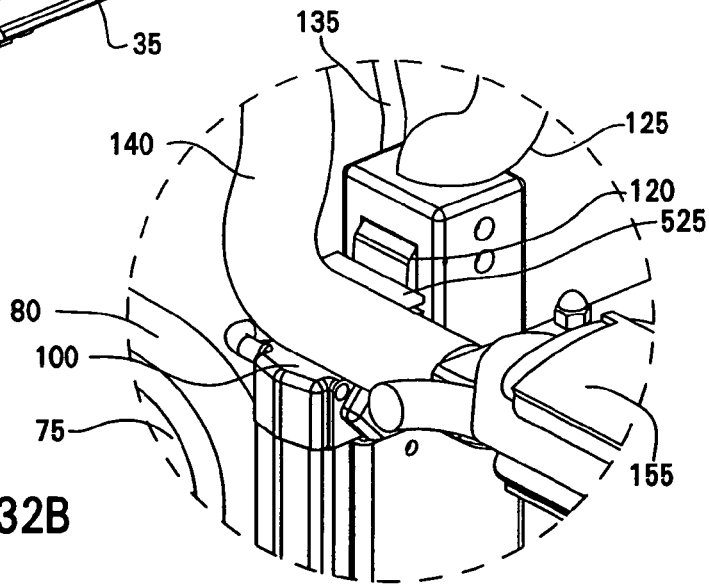
FIG. 32B is an enlarged detail view according to FIG. 32A.

Referring to FIGS. 32A and 32B, as the retractor bar 140 reaches the sill 95, 100, the retractor strap mount 525 contacts the safety shut-off switch 120. The safety shut-off switch 120 activates a safety feature of the motor and gear assembly, wherein the motor is stopped and briefly reversed in order to release any load on the straps 510, 515, and to release any object that might have been trapped as the retractor bar 140 traveled toward the patient transfer device 10.

Figure 33:
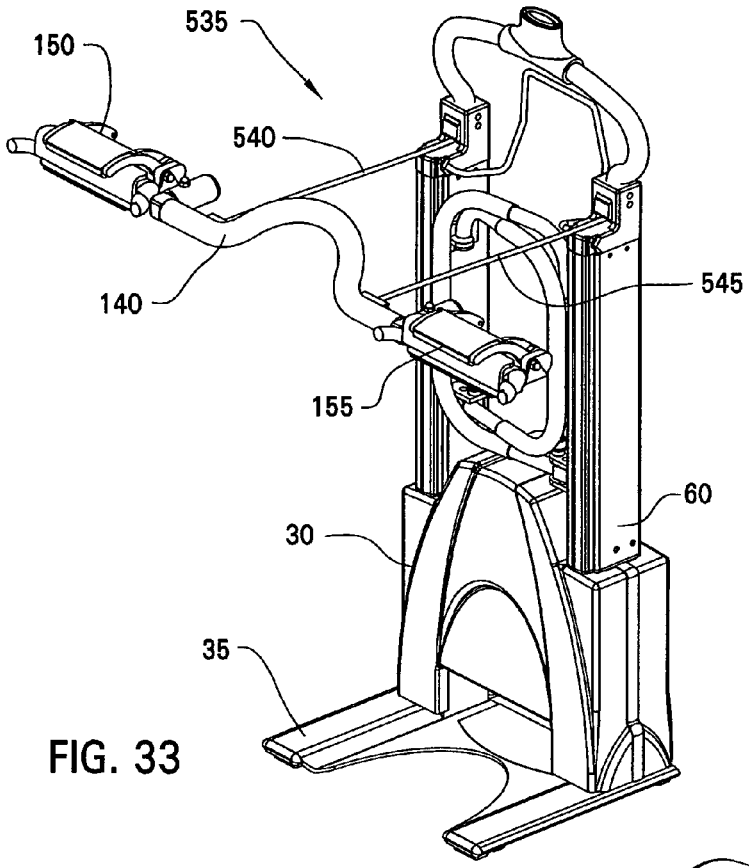
FIG. 33 is a perspective view of the patient transfer device according to a further embodiment of the invention.
Figure 34:
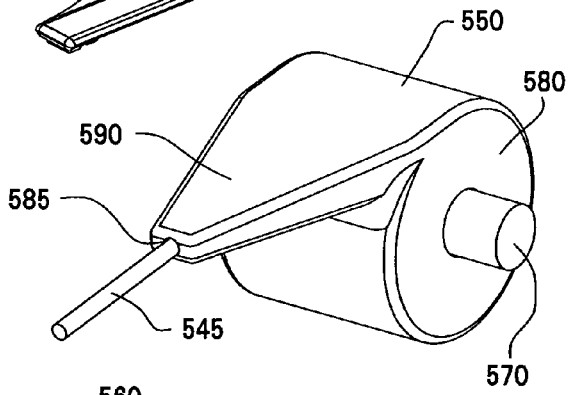
FIG. 34 is a perspective view of a cable assembly housing for the further embodiment of FIG. 33.
Figure 35:
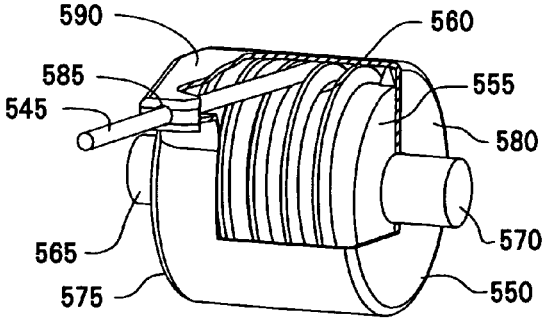
FIG. 35 is a partial cutaway perspective view of the cable housing of FIG. 34.

Now referring to FIGS. 33-35, an alternative retractor assembly 535 utilizes a pair of retractor cables 540, 545 for connecting the retractor bar 140 to the patient transfer device 10. Referring to FIGS. 34-35 the cable 545 is contained within a housing 550, and coiled on a drum 555 within the housing 550, the drum 555 having a helical groove 560. The drum 555 is rotatably mounted in the housing 550 by a pair of spindles 565, 570 extending through lateral walls 575, 580 of the housing 550. The cable 545 exits the housing through an aperture 585 in a tangential fan-shaped portion 590 of the housing 550. The drum 555 is driven by a bi-directional power source (not shown) configured to extend or retract the cable 545 from the housing 550.

Operation of the Patient Transfer Device

Figure 36:
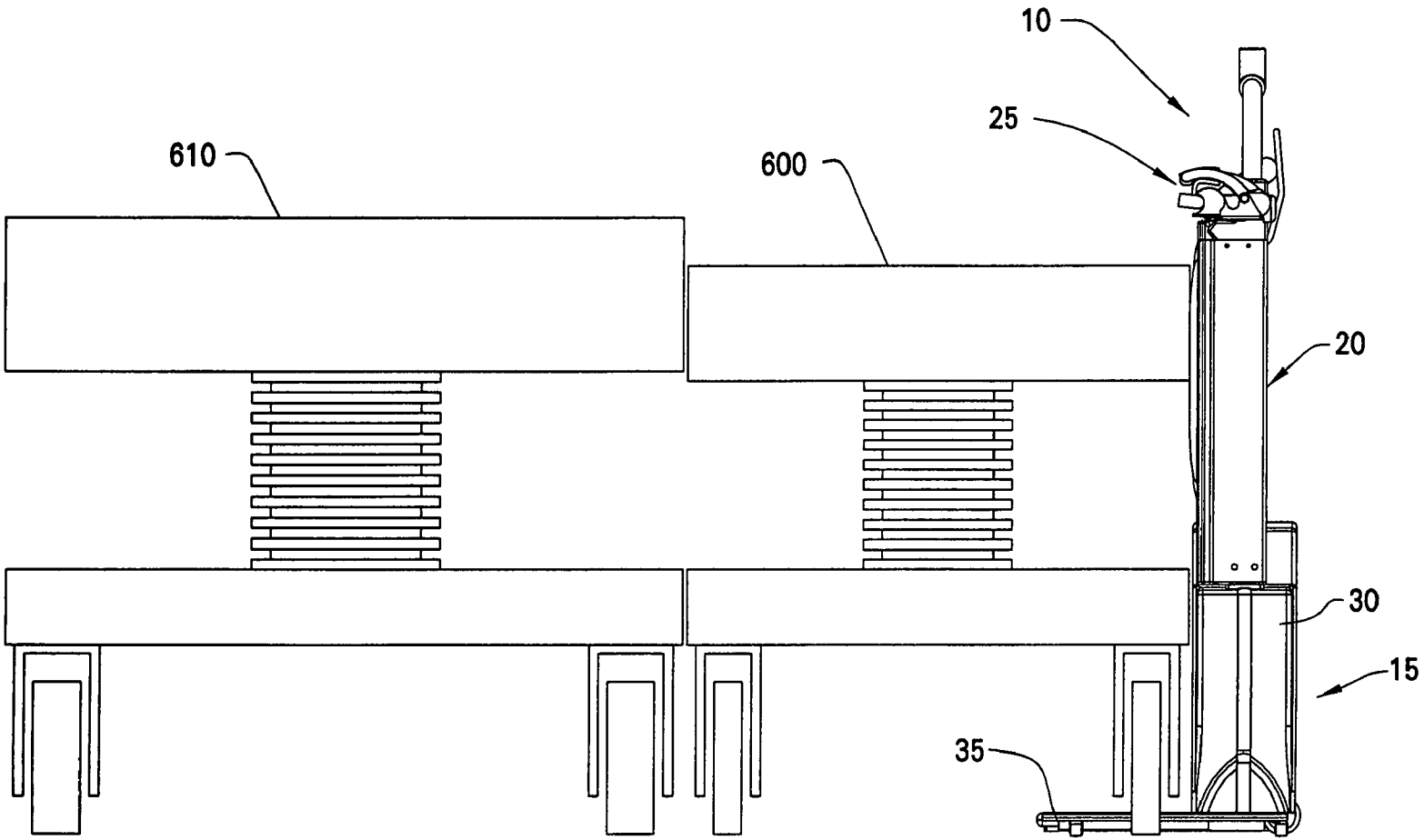
FIG. 36 is a side view of the patient transfer device in a use position adjacent a patient bed and receiving bed.
Figure 37:
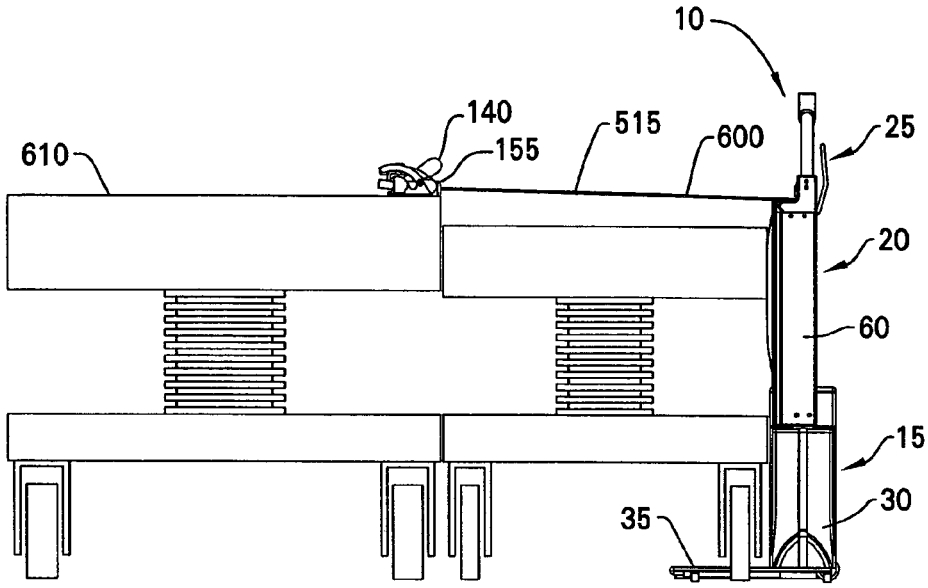
FIG. 37 is a side view of the patient transfer device adjacent the patient bed and receiving bed with the sheet clamping assembly extended.
Figure 38:
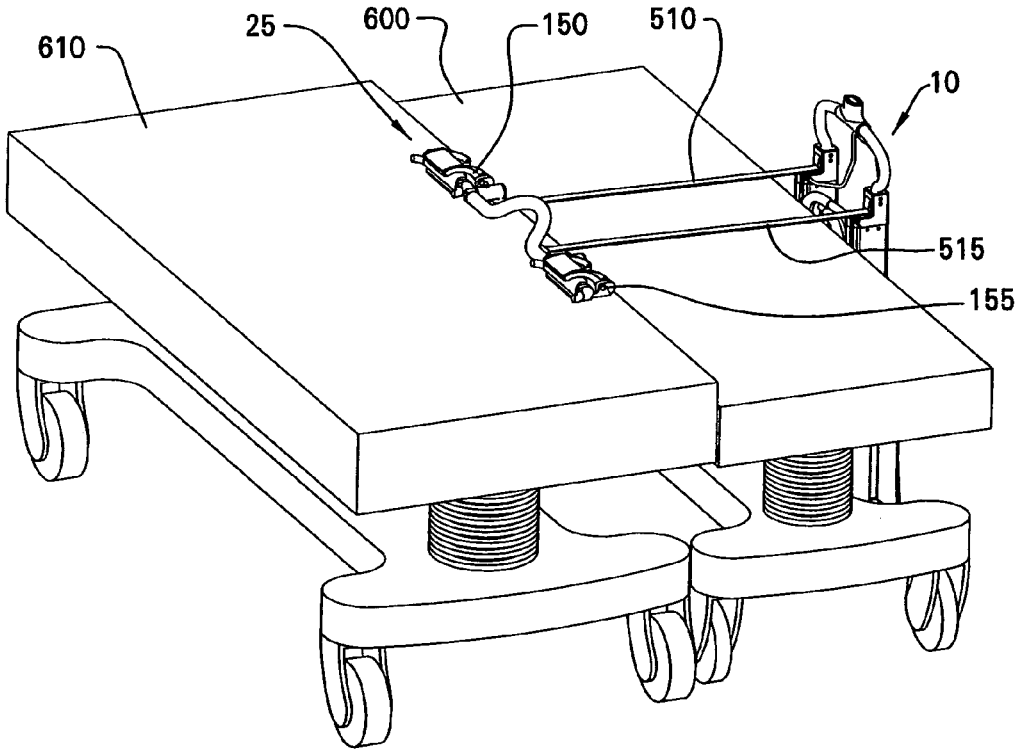
FIG. 38 is a perspective view according to FIG. 37.
Figure 39:
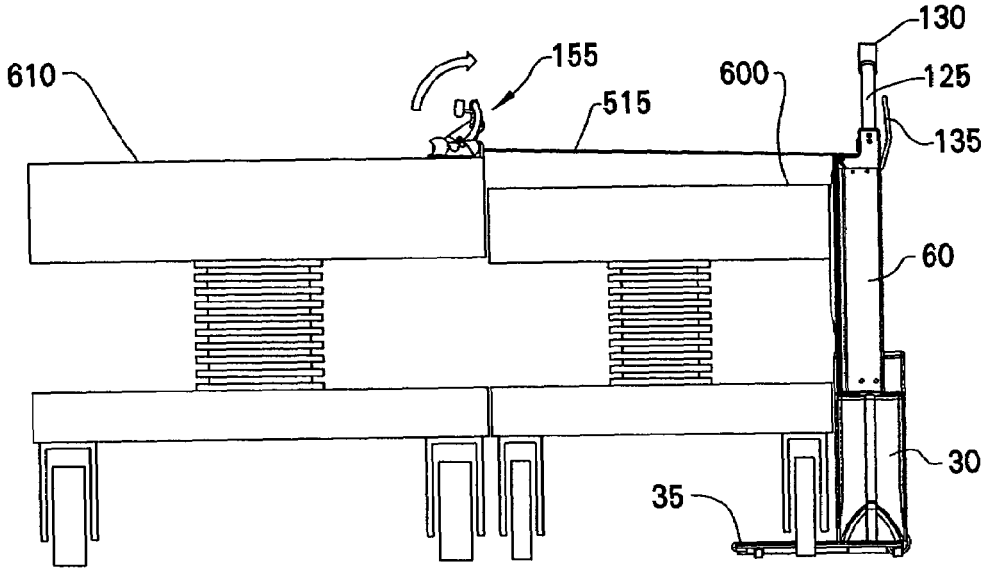
FIG. 39 is a side view according to FIG. 37 with the sheet clamping assembly in the open position.
Figure 40:
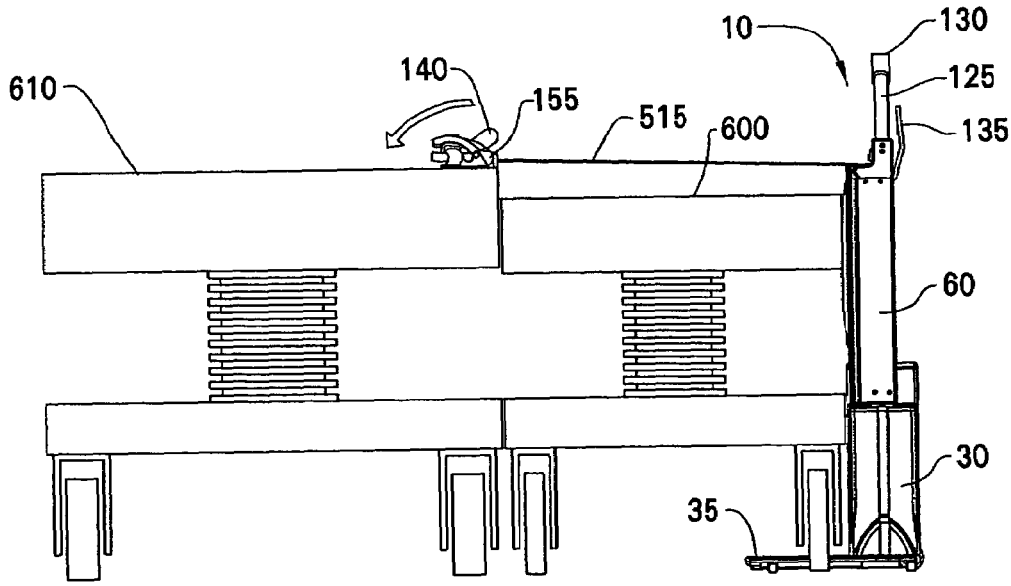
FIG. 40 is a side view according to FIGS. 37 through 39 with the sheet clamping assembly closed.
Figure 41:
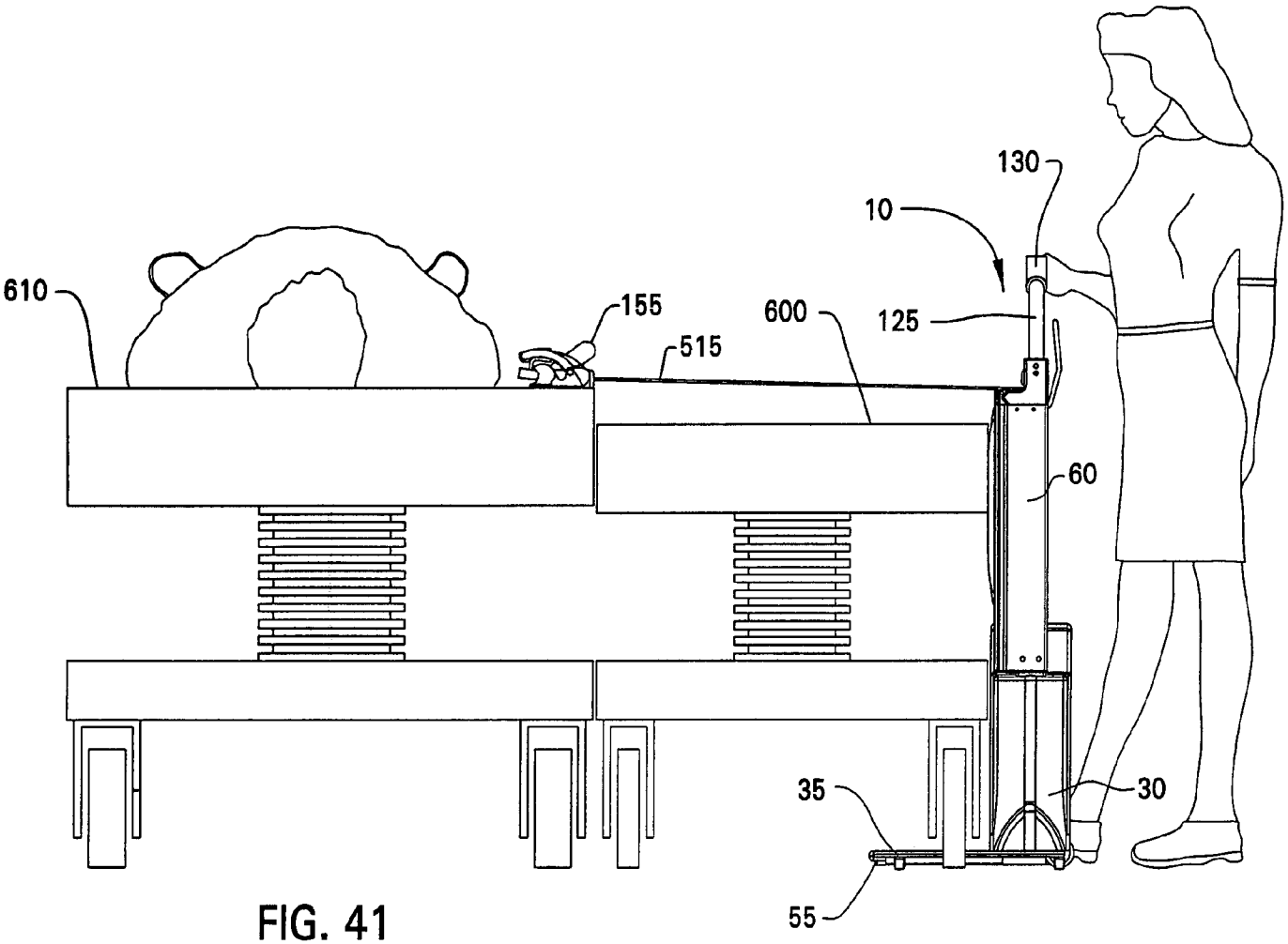
FIG. 41 is a side view of the patient transfer device according to FIGS. 36 through 40 with an attendant preparing to move a patient.
Figure 42:
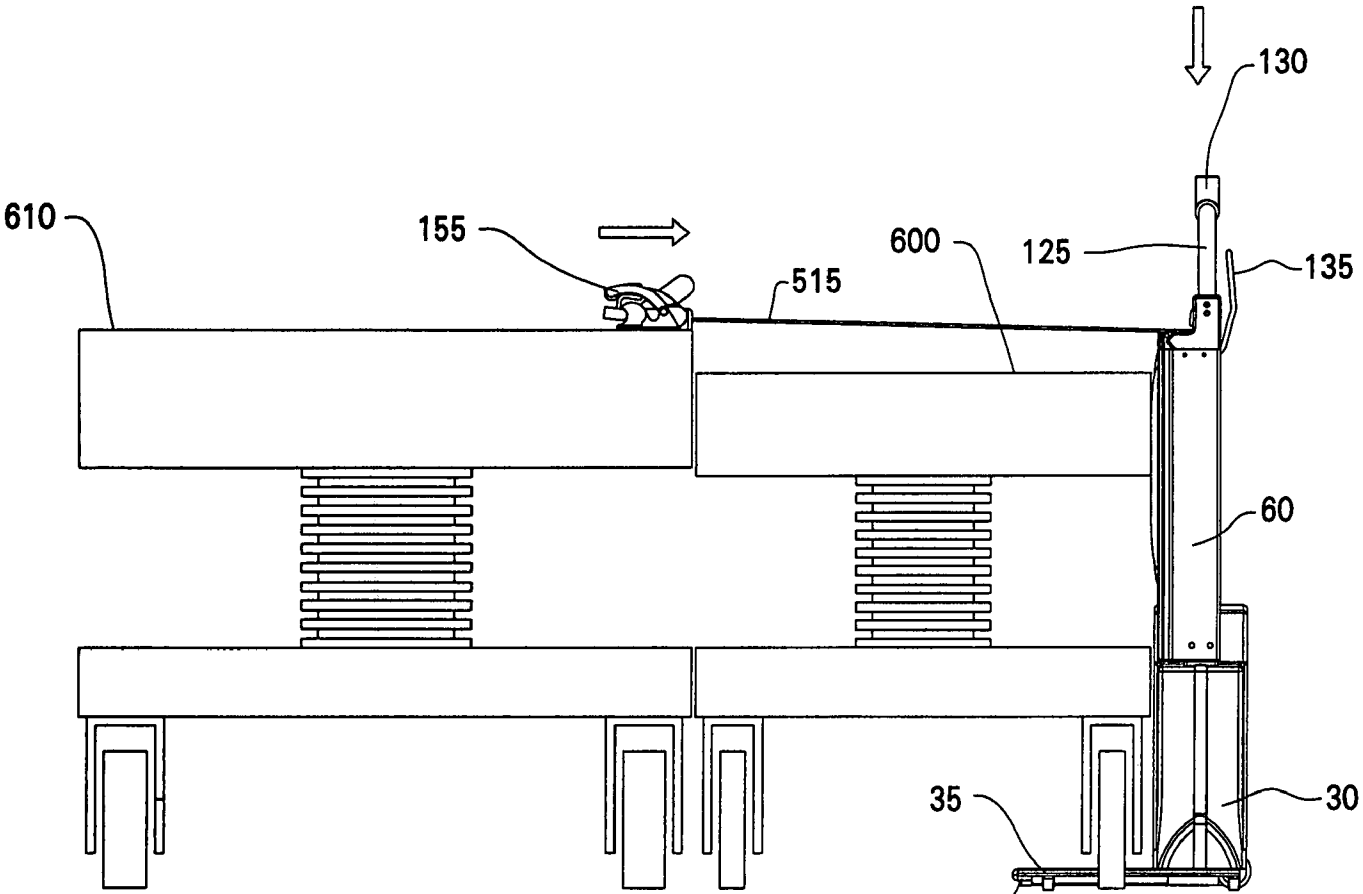
FIG. 42 is a side view of the patient transfer device according to FIGS. 36 through 41 in a retracting condition.

The patient transfer device 10 is operated in the following manner. A receiving bed 600 is moved adjacent a patient bed 610, and the patient transfer device 10 is positioned centered on the side of the receiving bed 600 opposite the patient bed 610, as shown in FIGS. 36-37. The surface of the receiving bed 600 should be lower than that of the patient bed 610. If not properly centered on the beds 600, 610, the patient transfer device can be moved laterally on the lateral positioning wheels 45 so that it is centered on the receiving bed 600.

The retractor assembly 25 is then extended across the receiving bed 600 to the patient bed 610. The sheet clamping assemblies 150, 155 are attached to the near side of a sheet 500 underneath the patient on the patient bed 610.

Prior to initiating retraction, the attendant places one foot on a foot counterbalance pad 615 formed in the base deck 35 of the patient transfer device 10. The weight of the attendant aids in counterbalancing the weight of the patient pulling on the upper end of the patient transfer device 10.

The patient transfer device 10 is activated by depressing the retractor activation switch 130 to draw the retractor assembly 25 back toward the patient transfer device 10. The anti-slip rubber toenails 55 grip the floor surface to prevent sliding of the base assembly 15 outwardly as the patient is drawn to the receiving bed 600.

Figure 43:
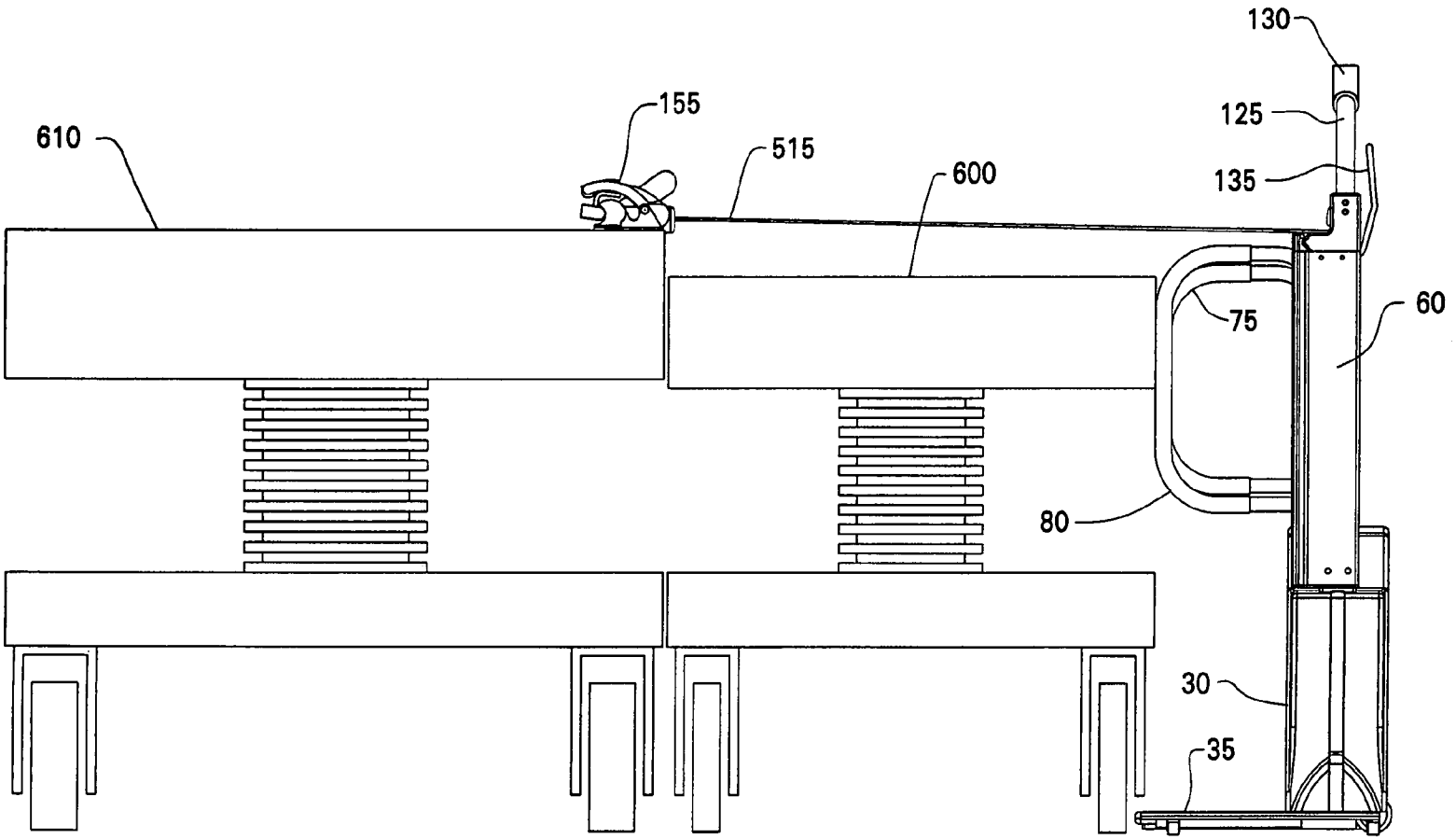
FIG. 43 is a side view of the patient transfer device according to FIGS. 36 through 42 with standoff tubes extended.
Figure 44:
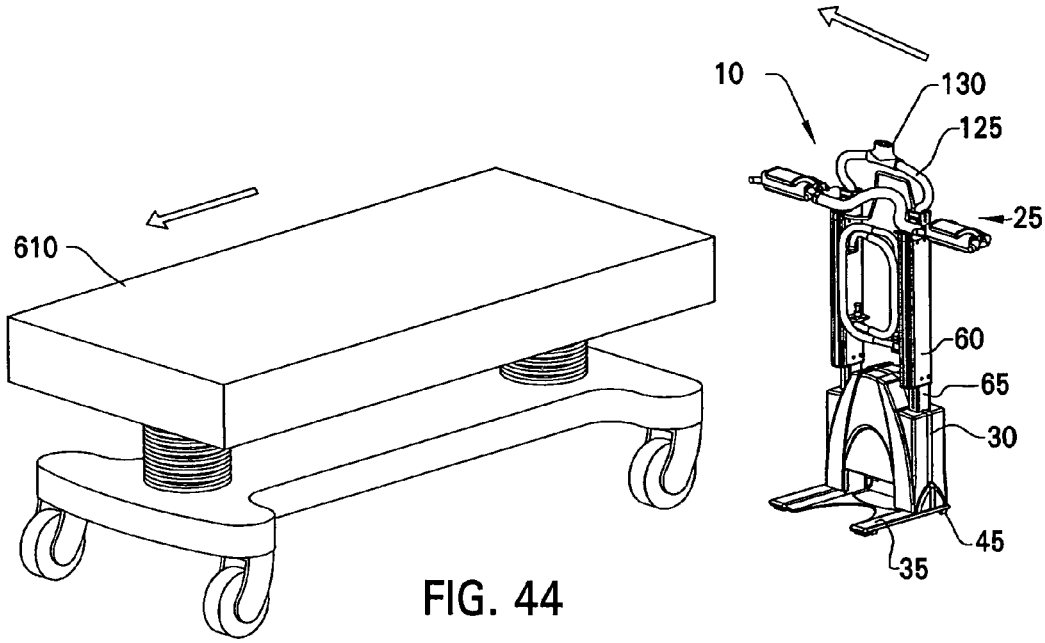
FIG. 44 is a perspective view of a patient transfer device according to FIGS. 1 through 43 being positioned adjacent a head end of a patient bed.
Figure 45:
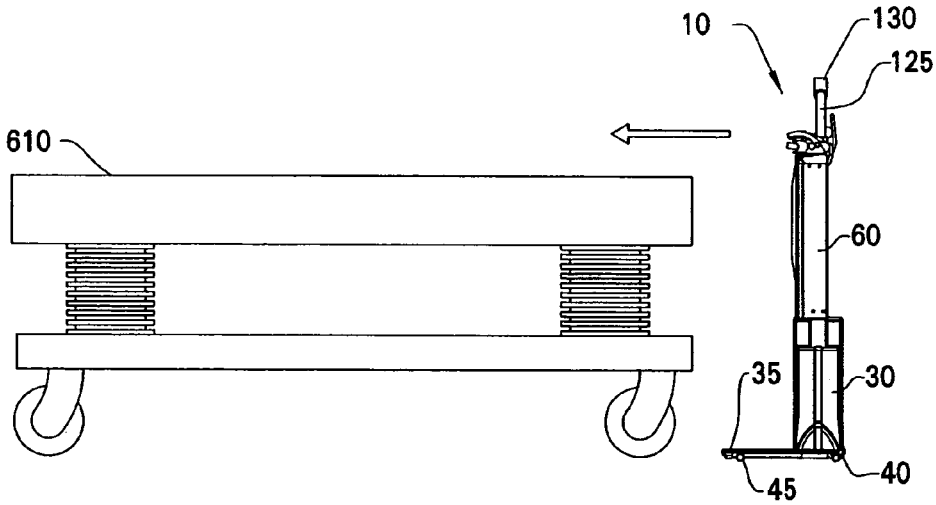
FIG. 45 is a side view of the patient transfer device of FIGS. 1 through 44 adjacent the head end of a patient bed.
Figure 46:
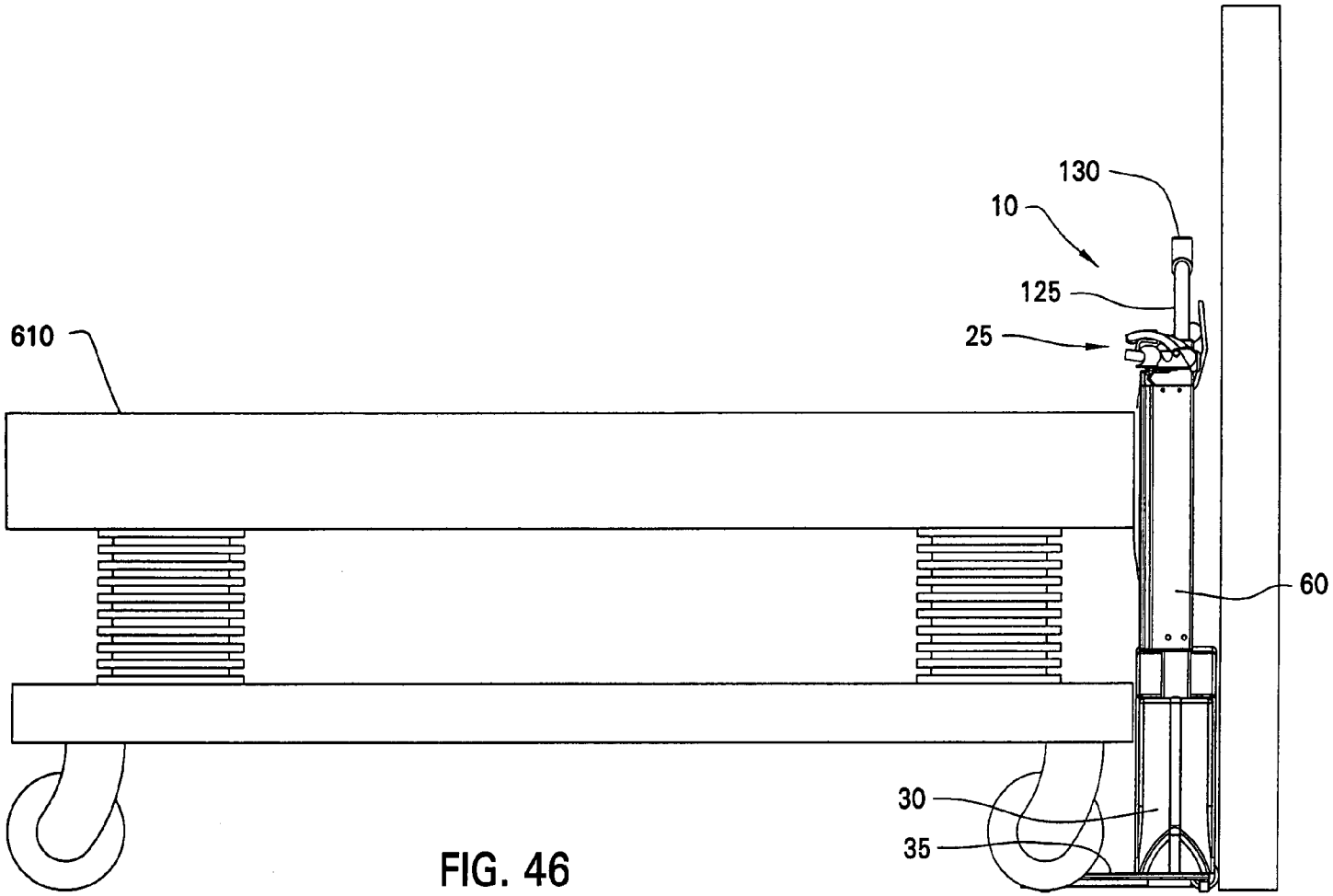
FIG. 46 is a side view of the patient transfer device of FIGS. 1 through 45 between a patient bed and an adjacent wall.
Figure 47:
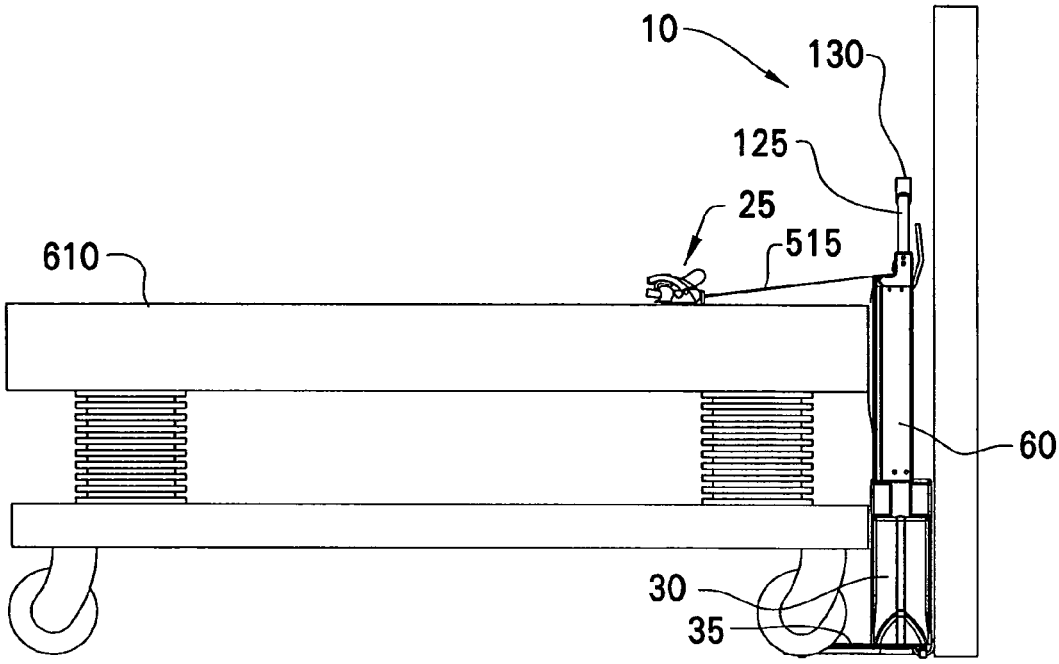
FIG. 47 is a side view of the patient transfer device of FIG. 46 with the retractor assembly extended.
Figure 48:
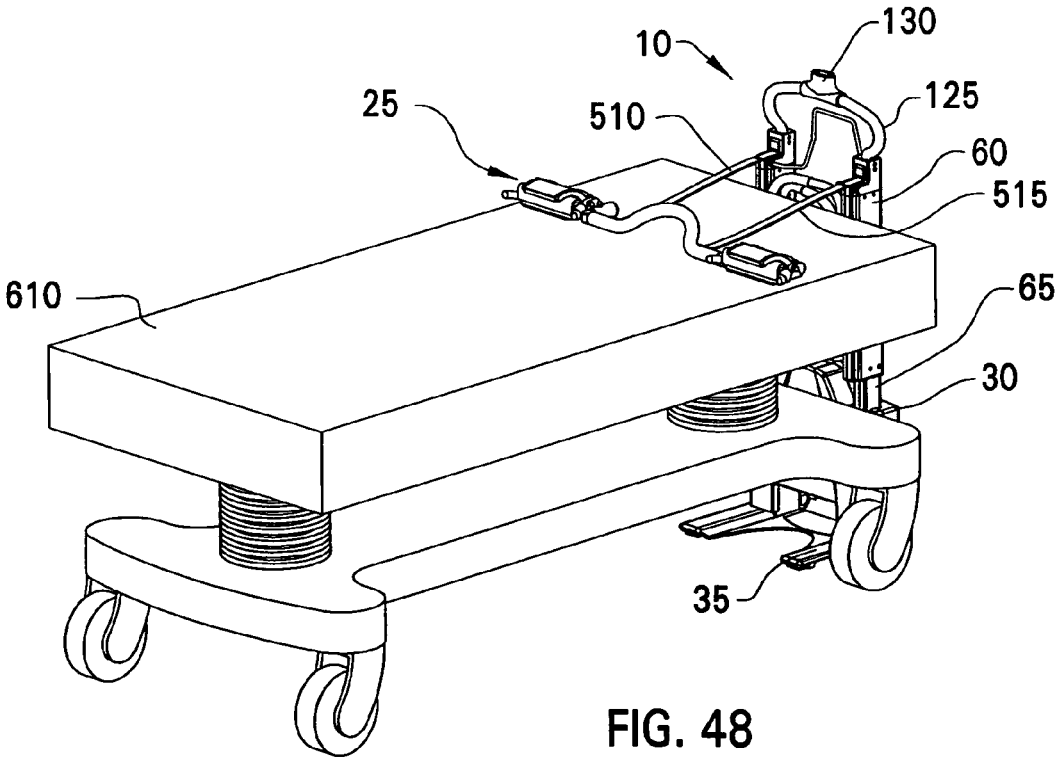
FIGS. 48 is a perspective view according to FIG. 47.
Figure 49:
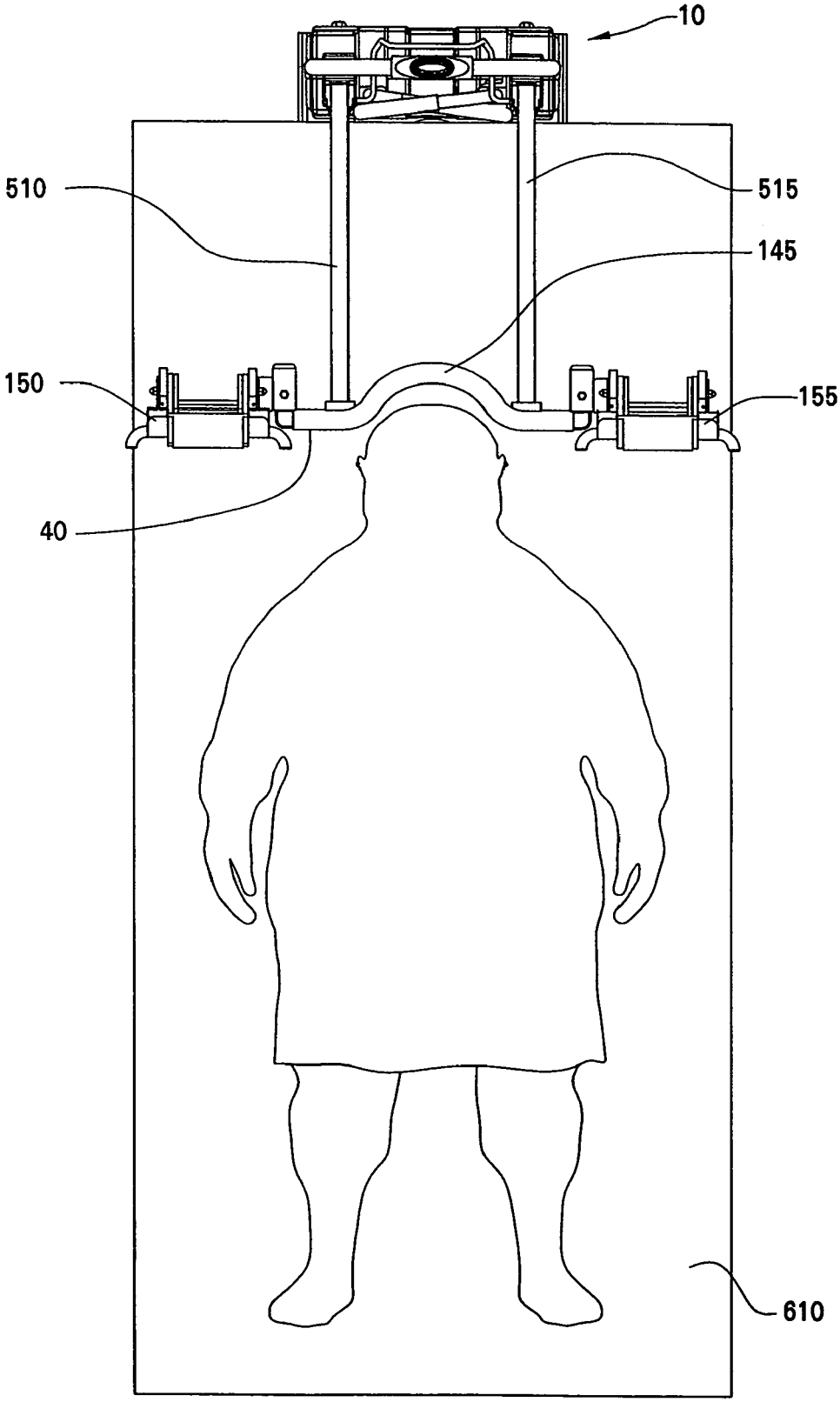
FIG. 49 is a plan view of the patient transfer device of FIGS. 44 through 47 with the retractor assembly extended to a patient on a patient bed.
Figure 50:
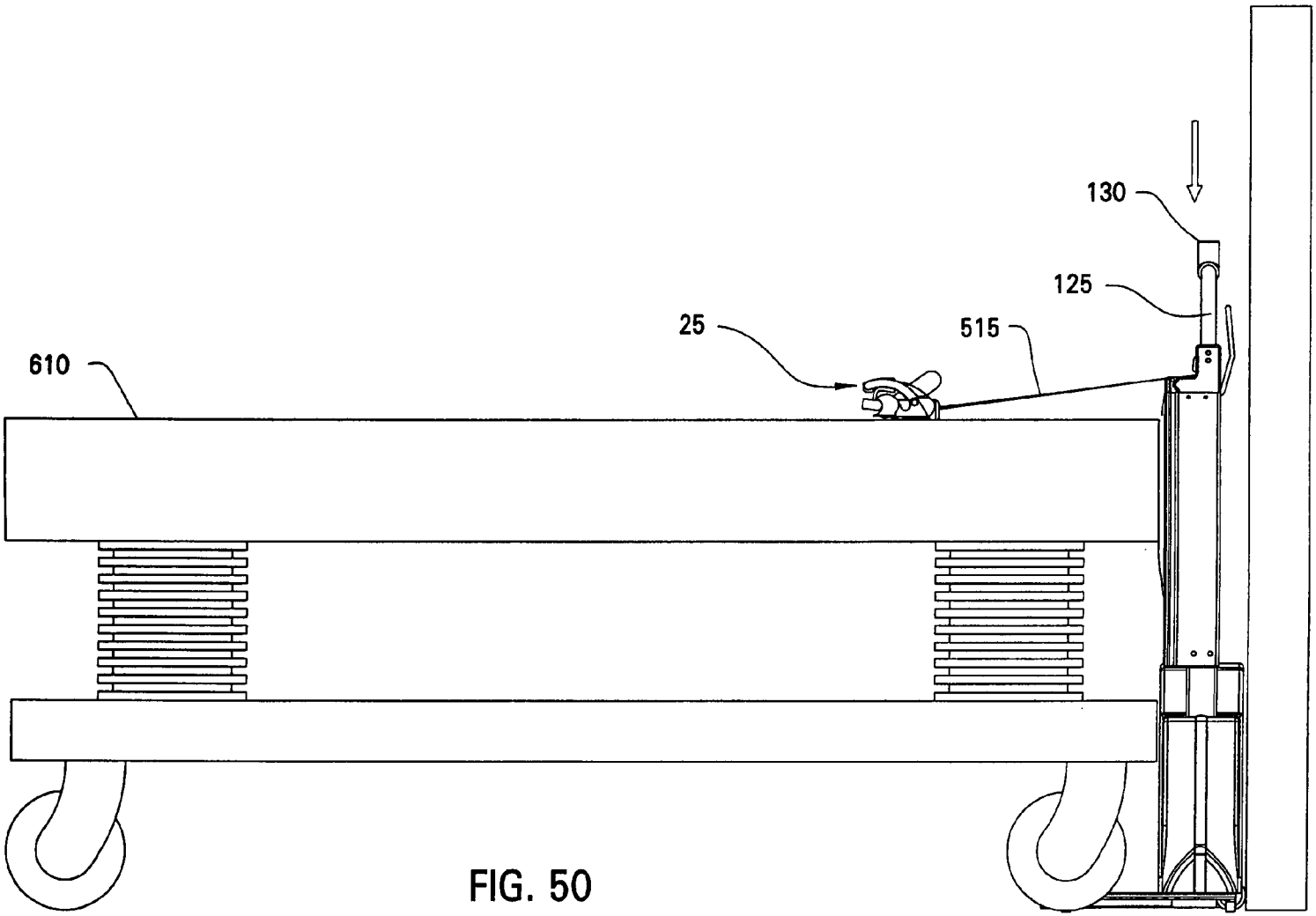
FIG. 50 is a side view of the patient transfer device of FIGS. 44 through 48 in the retracting condition.

In some cases, such as where there is an excess amount of sheet between the retractor bar 140 and the patient, or the receiving bed 600 is narrow, the patient transfer device must be held away from the receiving bed 600. The standoff tubes 75, 80 operate to provide additional maneuvering room or retraction room to move the patient on to the receiving bed 600, as shown in FIG. 43. If the attendant discovers the need for additional reach during the patient transfer, the patient transfer device 10 can be stopped and drawn away from the receiving bed 600, and the standoff tubes 75, 80 can be deployed. The attendant can then resume the transfer.

In another operating mode, the patient transfer device 10 can be laterally positioned between the bed 600, 610 and a wall surface using the lateral positioning wheels 45. This situation is particularly encountered in a boosting mode, wherein the patient transfer device 10 is used to boost a patient who has slid downwardly on the bed towards the foot of the bed.

Referring to FIGS. 44-49, the patient transfer device 10 is laterally positioned between a wall and the head of the patient bed 610. The retractor assembly is extended toward a patient's head with the patient's head being received in the head relief portion 145 of the retractor bar 140. The patient can then be boosted towards the head of the bed. Due to the limited clearance, the attendant cannot exert any force on the foot counter balance pad 615 of the base deck 35, but a backside of the patient transfer device 10 is forced against the wall behind the patient's bed and the wall serves as the counterbalance for the anti-slip rubber toenails 55 of the base assembly 15. The patient bed 610 must be prevented from shifting, such as by application of its wheel brakes, to prevent the action of the patient transfer device 10 from pushing the bed 610 away from the wall.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A patient transfer device for pull-up, rollover and transfer of a patient disposed on a sheet, comprising:

a base assembly including one or more wheels for movement of the base assembly;

a power train mounted within the base assembly;

a clamping and strap assembly including at least one strap attachable to the power train, a retractor bar attachable to the at least one strap and at least one clamping device pivotally attached to the retractor bar and releasably attachable to the sheet, the at least one clamping device including a clamp receiver, a clamp bar, a clamp handle pivotally connected to the clamp receiver and pivotal between a clamping position and a non-clamping position, wherein the receiver includes a concave surface for engagement by the clamp bar, and a compression assembly eccentrically pivotally connected to the clamp handle and pivotal between a clamping position and a non-clamping position, the compression assembly including a bight portion for engaging a clamping face of the clamp receiver and a pair of arm portions for pivotally connecting to the clamp handle, wherein the compression assembly is adapted to movably engage the clamp bar with the clamp receiver;

a power and switching system in electrical communication with the power train;

a vertical adjustment assembly operably adjoined between the base assembly and the clamping and strap assembly for adjusting the vertical position of the clamping and strap assembly, the vertical adjustment assembly including a pair of upstanding rails and a pair of upstanding sleeves slidably receiving the rails, the rails including a plurality of spaced indentations defining a plurality of vertical positions of the clamping and strap assembly, and at least one of the sleeves including a positioning mechanism for releasably locking the clamping and strap assembly at one of the plurality of vertical positions; and wherein the vertical adjustment assembly further comprises a standoff assembly, the standoff assembly projecting outwardly from the upstanding rails to thereby increase the travel distance off the clamping and strap assembly.

2. The patient transfer device of claim 1, wherein the standoff assembly comprises standoff tubes pivotally mounted to the sleeves.

3. A patient transfer device for pull-up, rollover and transfer of a patient disposed on a sheet, comprising:

a base assembly including one or more wheels for movement of the base assembly;

a power train mounted within the base assembly;

a clamping and strap assembly including at least one strap attachable to the power train, a retractor bar attachable to the at least one strap and at least one clamping device pivotally attached to the retractor bar and releasably attachable to the sheet, the at least one clamping device including a clamp base, a clamp handle pivotally connected to the clamp base and pivotal between a clamping position and a non-clamping position, and a compression assembly eccentrically pivotally connected to the clamp handle and pivotal between a clamping position and a non-clamping position, the compression assembly including a bight portion for engaging a clamping face of the clamping base and a pair of arm portions for pivotally connecting to the clamp handle;

a power and switching system in electrical communication with the power train;

a vertical adjustment assembly operably adjoined between the base assembly and the clamping and strap assembly for adjusting the vertical position of the clamping and strap assembly, the vertical adjustment assembly including a pair of upstanding rails and a pair of upstanding sleeves slidably receiving the rails, the rails including a plurality of spaced indentations defining a plurality of vertical positions of the clamping and strap assembly, and at least on of the sleeves including a positioning mechanism for releasably locking the clamping and strap assembly at one of the plurality of vertical positions;

wherein the vertical adjustment assembly further comprises a standoff assembly;

wherein the standoff assembly comprises standoff tubes pivotally mounted to the sleeves; and wherein the standoff tubes are pivotal between a use position extending toward the patient and a stowed position nested between the upstanding rails.

4. The patient transfer device of claim 3, wherein the retractor bar further comprises a head relief portion.

5. The patient transfer device of claim 3, wherein the sleeves are connected by a handle.

6. The patient transfer device of claim 5, wherein a power switch is mounted in the handle.

7. The patient transfer device of claim 6, wherein the positioning mechanism further comprises an unlocking lever pivotally mounted between the sleeves and configured for access by an operator holding onto the handle.

8. The patient transfer device of claim 3, wherein the positioning mechanism further comprises an unlocking lever pivotally mounted between the sleeves.

9. The patient transfer device of claim 3, wherein the base assembly further comprises at least one anti-slip rubber toenail.

10. The patient transfer device of claim 3, wherein the clamping and strap assembly further includes a safety switch adapted to release a load on the strap assembly to thereby provide automatic strain relief.

11. The patient transfer device of claim 3, wherein the sleeves further comprise resilient bumper strips.

12. The patient transfer device of claim 3, wherein the straps travel through the vertical adjustment assembly from the power train to the clamping and strap assembly.

13. The patient transfer device of claim 3, wherein the base assembly includes a foot counterbalance pad configured to receive the foot of an attendant during patient transfer.

14. A patient transfer device for pull-up, rollover and transfer of a patient disposed on a sheet, comprising:

a base assembly including a pair of rear more transport wheels for fore and aft movement of the base assembly across a floor surface and a pair of rear and a pair of forward lateral positioning wheels for lateral positioning of the base assembly across the floor surface, the transport wheels being in proximity to said pair of rear lateral positioning wheels and mounted to said base assembly such that the transport wheels are disengaged from the floor surface when the pairs of rear and forward lateral wheels are engaged with the floor surface, and said rear transport wheels are engaged with the floor surface when the pairs of rear and forward lateral wheels are disengaged with the floor surface, wherein the wheels for lateral positioning of the base assembly are operable independent of and mutually exclusive of the wheels for movement of the base assembly; wherein said rear transport wheels rotate about an axis orthogonal to a rotational axis of each lateral wheel;

a power train mounted within the base assembly;

a clamping and strap assembly configured to clamp to a sheet and operably connected to the power train for retracting the clamping and strap assembly toward the patient transfer device;

a power and switching system in electrical communication with the power train; and a vertical adjustment assembly operably adjoined between the base assembly and the clamping and strap assembly for adjusting the vertical position of the clamping and strap assembly.

15. The patient transfer device of claim 14, wherein the base assembly further comprises at least one anti-slip rubber toenail.

16. The patient transfer device of claim 15, wherein the base assembly includes a foot counterbalance pad configured to receive the foot of an attendant during patient transfer.

17. The patient transfer device of claim 14, wherein the base assembly includes a foot counterbalance pad configured to receive the foot of an attendant during patient transfer.

18. The patient transfer device of claim 14, wherein the wheels for movement of the base assembly are rotatably mounted on fixed movement axes transverse to a direction of movement of the patient transfer device.

19. The patient transfer device of claim 18, wherein the wheels for lateral positioning of the base assembly are rotatably mounted on fixed positioning axes perpendicular to the fixed movement axes.

20. A patient transfer device for pull-up, rollover and transfer of a patient disposed on a sheet, comprising:

a base assembly;

a power train mounted within the base assembly;

a clamping and strap assembly including at least one strap attachable to the power train, a retractor bar attachable to the at least one strap and at least one clamping device attached to the retractor bar and releasably attachable to the sheet, the at least one clamping device including a clamp receiver, a clamp bar, a clamp handle pivotally connected to the clamp receiver and pivotal between a clamping position and a non-clamping position, wherein the receiver includes a concave surface engageable by the clamp bar and a compression assembly eccentrically pivotally connected to the clamp handle and pivotal between a clamping position and a non-clamping position, the compression assembly including a bight portion for engaging a clamping face of the clamp receiver and a pair of arm portions for pivotally connecting to the clamp handle, wherein the compression assembly is adapted to movably engage the clamp bar with the clamp receiver;

a power and switching system in electrical communication with the power train; and a vertical adjustment assembly operably adjoined between the base assembly and the clamping and strap assembly for adjusting the vertical height of the clamping and strap assembly.

21. The patient transfer device of claim 20, wherein the retractor bar further comprises a head relief portion.

22. The patient transfer device of claim 20, wherein the clamping and strap assembly further includes a safety switch adapted to release a load on the strap assembly to thereby provide automatic strain relief.

23. The patient transfer device of claim 20, wherein the straps travel through the vertical adjustment assembly from the power train to the clamping and strap assembly.

24. A patient transfer device for pull-up, rollover and transfer of a patient disposed on a sheet comprising:

a base assembly;

a power train mounted within the base assembly;

a clamping and strap assembly configured to clamp to the sheet and operably connected to the power train;

a power and switching system in electrical communication with the power train;

a vertical adjustment assembly operably adjoined between the base assembly and the clamping and strap assembly for adjusting the vertical position of the clamping and strap assembly, the vertical adjustment assembly including a pair of upstanding rails and a pair of upstanding sleeves slidably receiving the rails, the rails including a plurality of spaced indentations defining a plurality of vertical positions of the clamping and strap assembly, and at least one of the sleeves including a positioning mechanism for releasably locking the clamping and strap assembly at one of the plurality of vertical positions;

wherein the vertical adjustment assembly further comprises standoff tubes;

wherein the standoff tubes are pivotally mounted to the sleeves; and wherein the standoff tubes are pivotal between a use position extending toward the patient and a stowed position nested between the upstanding rails.

25. The patient transfer device of claim 24, wherein the sleeves are connected by a handle.

26. The patient transfer device claim 25, wherein a power switch is mounted in the handle.

27. The patient transfer device of claim 26, wherein the positioning mechanism further comprises an unlocking lever pivotally mounted between the sleeves and configured for access by an operator holding onto the handle.

28. The patient transfer device of claim 24, wherein the positioning mechanism further comprises an unlocking lever pivotally mounted between the sleeves.

29. The patient transfer device of claim 24, wherein the sleeves further comprise resilient bumper strips.

* * * * *

UNITED STATES PATENT AND TRADEMARK OFFICE

CERTIFICATE OF CORRECTION

PATENT NO. : 7,340,784 B2
APPLICATION NO. : 11/151064
DATED : March 11, 2008
INVENTOR(S) : Martin W. Stryker et al.

It is certified that error appears in the above-identified patent and that said Letters Patent is hereby corrected as shown below:

Column 9:
Line 58, Claim 1, “off” should be --of--.

Column 10:
Line 25, Claim 3, “on” should be --one--.

Column 11:
Line 1, Claim 14, Delete “more” before “transport”.
Line 6, Claim 14, Insert --rear-- before “transport”.
Line 57, Claim 20, Insert --pivotally-- before “attached”.

Column 12:
Line 52, Claim 26, Insert --of-- before “claim”.

Signed and Sealed this

Third Day of February, 2009

JOHN DOLL
*Acting Director of the United States Patent and Trademark Office*